US009352589B2

(12) United States Patent
Katoh et al.

(10) Patent No.: US 9,352,589 B2
(45) Date of Patent: May 31, 2016

(54) MODIFICATION DEVICE, MODIFICATION METHOD, COMPUTER PROGRAM PRODUCT, IMAGE FORMING APPARATUS, AND IMAGE FORMING SYSTEM

(71) Applicants: Satoshi Katoh, Kanagawa (JP); Kengo Tsubaki, Kanagawa (JP); Hiroyuki Hiratsuka, Kanagawa (JP); Haruki Saitoh, Kanagawa (JP)

(72) Inventors: Satoshi Katoh, Kanagawa (JP); Kengo Tsubaki, Kanagawa (JP); Hiroyuki Hiratsuka, Kanagawa (JP); Haruki Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/864,735

(22) Filed: Sep. 24, 2015

(65) Prior Publication Data

US 2016/0096377 A1 Apr. 7, 2016

(30) Foreign Application Priority Data

Oct. 2, 2014 (JP) ..... 2014 203865
Jul. 30, 2015 (JP) ..... 2015 150963

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
USPC ..... 347/100–106, 171, 222, 223
See application file for complete search history.

(56) References Cited

U.S. PATENT DOCUMENTS 8,186,823 B2 * 5/2012 Saitoh ..... B41J 11/0015 347/102
2009/0207224 A1 * 8/2009 Cofler ..... B41J 11/002 347/102
2014/0078212 A1 * 3/2014 Nakai ..... B41J 11/0015 347/16
2014/0160197 A1 6/2014 Hirose et al.
2015/0035918 A1 2/2015 Matsumoto et al.
2015/0077458 A1 3/2015 Osanai et al.
2015/0077493 A1 3/2015 Saitoh
2015/0138287 A1 5/2015 Saitoh
2015/0202894 A1 * 7/2015 Kitada ..... B41J 11/002 347/102

FOREIGN PATENT DOCUMENTS

JP 2001-183796 7/2001
JP 2003-257646 9/2003
JP 2003-311940 11/2003
JP 2008-116610 5/2008
JP 2009-279796 12/2009

OTHER PUBLICATIONS

U.S. Appl. No. 14/642,587, filed Mar. 9, 2015.
U.S. Appl. No. 14/642,575, filed Mar. 9, 2015.
U.S. Appl. No. 14/656,552, filed Mar. 12, 2015.
U.S. Appl. No. 14/657,946, filed Mar. 13, 2015.
U.S. Appl. No. 14/657,922, filed Mar. 13, 2015.

* cited by examiner

*Primary Examiner* — Kristal Feggins
(74) *Attorney, Agent, or Firm* — Duft Bornsen & Fettig LLP

(57) ABSTRACT

A modification device includes: a plasma processing unit that performs plasma processing on a processed object such that a surface of the processed object has a predetermined water contact angle; and a cooling unit that cools the surface of the processed object at least from when the plasma processing is performed to when ink is discharged such that a surface temperature of the processed object during discharge of the ink to the processed object is a temperature at which a target water contact angle range is achieved.

14 Claims, 12 Drawing Sheets

MODIFICATION DEVICE, MODIFICATION METHOD, COMPUTER PROGRAM PRODUCT, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2014-203865 filed in Japan on Oct. 2, 2014 and Japanese Patent Application No. 2015-150963 filed in Japan on Jul. 30, 2015.

BACKGROUND OF THE INVENTION

1. Field of the Invention

The present invention relates to a modification device, a modification method, a computer program product, an image forming apparatus, and an image forming system.

2. Description of the Related Art

There are disclosed techniques for generating plasma to modify the surface of a processed object, such as a recording medium (for example, Japanese Patent Application Laid-open No. 2009-279796 and Japanese Patent Application Laid-open No. 2003-311940). The surface of a processed object is modified so that the water contact angle of the surface of the processed object can be decreased. Furthermore, it is known that images are formed by discharging the ink to a processed object on which modification processing has been performed.

However, no considerations are heretofore given to the heat that is generated during plasma processing. Therefore, the heat that is applied during plasma processing sometimes causes a reduction in the modification effect of the surface of a processed object.

SUMMARY OF THE INVENTION

It is an object of the present invention to at least partially solve the problems in the conventional technology.

A modification device includes: a plasma processing unit that performs plasma processing on a processed object such that a surface of the processed object has a predetermined water contact angle; and a cooling unit that cools the surface of the processed object at least from when the plasma processing is performed to when ink is discharged such that a surface temperature of the processed object during discharge of the ink to the processed object is a temperature at which a target water contact angle range is achieved.

A modification method includes: performing plasma processing on a processed object such that a surface of the processed object has a predetermined water contact angle; and cooling the surface of the processed object at least from when the plasma processing is performed to when ink is discharged such that a surface temperature of the processed object during discharge of the ink to the processed object is a temperature at which a target water contact angle range is achieved.

A computer program product includes a non-transitory computer-readable medium having an information processing program. The program causes a computer to execute: performing plasma processing on a processed object such that a surface of the processed object has a predetermined water contact angle; and cooling the surface of the processed object at least from when the plasma processing is performed to when ink is discharged such that a surface temperature of the processed object during discharge of the ink to the processed object is a temperature at which a target water contact angle range is achieved.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
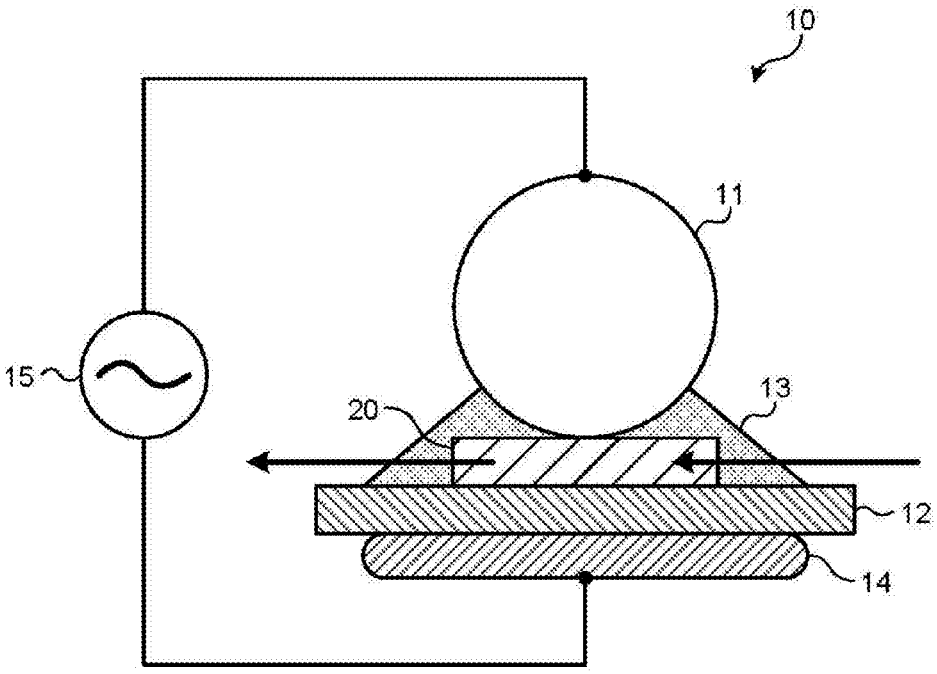
FIG. 1 is a schematic explanatory diagram of plasma processing that is used according to the present embodiment.

With reference to the drawings, a detailed explanation is given below of an embodiment of a modification device, a modification method, a computer program product, an image forming apparatus, and an image forming system.

First Embodiment

In the present embodiment, plasma processing is performed on a processed object.

The processed object used in the present embodiment is, for example, an impermeable recording medium, a slowly permeable recording medium, and a permeable recording medium.

Impermeable recording media refer to recording media which liquid drops of ink, or the like, do not actually permeate. Here, "do not actually permeate" means that the permeation rate of liquid drops after one minute is equal to or less than 5%. Impermeable recording media include, for example, art paper, synthetic resin, rubber, coated paper, glass, metal, ceramic, or wood. Furthermore, in the purpose of the addition of functionality, multiple ones of the above materials may be combined so that a complex base material is used. Moreover, it is possible to use a medium that is obtained by forming the above-described impermeable layer (e.g., a coated layer) on regular paper, or the like.

Furthermore, slowly permeable recording media refer to recording media such that, if the liquid drops of 10 picoliters (pl) fall on a recording medium, it takes equal to or more than 100 msec before the entire amount of liquids permeate and, specifically, they includes art paper, or the like. Permeable recording media refer to recording media such that, if the liquid drops of 10 pl fall on a recording medium, it takes equal to or less than 100 msec before the entire amount of liquids permeate and, specifically, they include regular paper, porous paper, or the like.

The present embodiment is especially effective in a case where an impermeable recording medium or a slowly permeable recording medium is used as a processed object.

Furthermore, the processed object is sometimes referred to as a recording medium below.

If plasma processing is performed on the surface of the processed object, the water contact angle of the surface of the processed object is decreased, and the wetting property is improved. If the wetting property of the surface of the processed object is improved, a dot is quickly spread after it falls on the processed object on which plasma processing has been performed. Therefore, it is possible to quickly dry the ink on the surface of the processed object. Thus, the distribution of ink pigments is prevented, and the pigments are agglomerated. As a result, it is possible to prevent the occurrence of beading, bleed, or the like. Furthermore, as the pigments are agglomerated, the surface roughness of the ink layer can be adjusted. The beading means the phenomenon such that adjacent dots are connected on the processed object, and an irregular space, an increase in the density, or the like, occurs, which degrades the image quality.

Specifically, during plasma processing, an organic substance on the surface undergoes oxidation reaction due to active species, such as oxygen radical, hydroxyl radical (—OH), or ozone, which are generated due to plasma, and a hydrophilic functional group is formed.

Therefore, by using plasma processing, the wetting property (hydrophilic property) of the surface of the processed object can be controlled, and also the pH value of the surface of the processed object can be controlled (acidification). Furthermore, by using plasma processing, it is possible to control the agglomerating property of the pigment that is included in the ink layer that is formed on the processed object on which plasma processing has been performed.

Moreover, by using plasma processing, the permeability can be controlled so that the roundness of an ink dot (hereafter, simply referred to as a dot) is improved, and dots can be prevented from combining with each other, whereby the sharpness of dots or the color gamut can be increased. As a result, an image defect, such as beading or bleed, can be eliminated, and a printed material with a high-quality image formed thereon can be obtained. Furthermore, the thickness of pigments that are agglomerated on the processed object is made uniformly thin, whereby the amount of ink droplets can be reduced, and a reduction in the ink drying energy and in the printing costs can be achieved.

Furthermore, according to the present embodiment, the surface of the processed object is cooled at least from when plasma processing is performed to when the ink is discharged. According to the present embodiment, the cooling prevents a reduction in the modification effect of plasma processing (details are given later). Here, the modification effect means the effect of the above-described plasma processing, and it means the effect of a decrease in the water contact angle, an improvement in the wetting property, acidification, or the like. Especially, according to the present embodiment, the modification effect principally means the effect of a decrease in the water contact angle.

FIG. 1 is a schematic explanatory diagram of plasma processing that is used according to the present embodiment. As illustrated in FIG. 1, for the plasma processing that is used according to the present embodiment, a plasma processing unit 10 is used, which includes a discharge electrode 11, an earth electrode 14, a dielectric 12, and a voltage applying unit 15. The dielectric 12 is provided between the discharge electrode 11 and the earth electrode 14. The earth electrode 14 is located opposite to the discharge electrode 11.

The earth electrode 14 may be, for example, a roller-type electrode whose surface layer is coated with silicon or may be an electrode that is formed of an alumina material. The discharge electrode 11 uses, for example, a SUS material. Furthermore, the discharge electrode 11 may be formed of a material that generates discharge plasma, and there is no limitation on its material. There is no limitation on the shape of the discharge electrode 11. For example, the discharge electrode 11 may have any shape, such as the shape of a blade, the shape of a wire, or the shape of a roller.

The surface of the earth electrode 14 is covered with an insulating material, such as polyimide, silicon, or ceramic. Furthermore, the discharge electrode 11 may be configured such that a metallic section is exposed, or it may be covered with a dielectric or an insulating material, such as an insulating rubber or ceramic.

The voltage applying unit 15 applies a high-frequency/high-voltage pulse voltage between the discharge electrode 11 and the earth electrode 14.

The voltage value of the pulse voltage is, for example, about 10 kilovolts (kV) (p-p). Furthermore, the frequency is, for example, about 20 kilohertz (kHz). This high-frequency/high-voltage pulse voltage is fed between the two electrodes so that non-equilibrium atmospheric pressure plasma 13 is generated between the discharge electrode 11 and the dielectric 12. A processed object 20 is passed between the discharge electrode 11 and the dielectric 12 while the non-equilibrium atmospheric pressure plasma 13 is generated. Thus, plasma processing is performed on a surface of the processed object 20.

Here, FIG. 1 illustrates, for example, a case where the plasma processing unit 10 uses the roll-shaped rotary discharge electrode 11 and the conveyor-belt dielectric 12. For example, the processed object 20 is sandwiched and conveyed between an undepicted conveyance mechanism or the rotating discharge electrode 11 and the dielectric 12 so that it is passed through the non-equilibrium atmospheric pressure plasma 13. Thus, the processed object 20 is brought into contact with the non-equilibrium atmospheric pressure plasma 13 and is subjected to plasma processing. The non-equilibrium atmospheric pressure plasma 13 is the plasma that uses dielectric barrier discharge.

Plasma processing using the non-equilibrium atmospheric pressure plasma 13 is one of the preferred plasma processing methods for the processed object 20 as the electron temperature is extremely high and the gas temperature is near the normal temperature.

To generate the non-equilibrium atmospheric pressure plasma 13 over a wide range in a stable manner, it is preferable to perform non-equilibrium atmospheric pressure plasma processing that uses streamer-breakdown dielectric barrier discharge. The streamer-breakdown dielectric barrier discharge can be obtained by applying an alternating high voltage between the electrodes that are covered with, for example, a dielectric.

Furthermore, as the method for generating the non-equilibrium atmospheric pressure plasma 13, various methods can be used other than the streamer-breakdown dielectric barrier discharge. For example, it is possible to use dielectric barrier discharge for which an insulating material, such as a dielectric, is inserted between electrodes, corona discharge for which a significantly non-uniform electric field is formed in a thin metallic wire, or the like, or pulse discharge for which a short-pulse voltage is applied. Furthermore, it is possible to combine two or more methods out of the above methods. Moreover, according to the present embodiment, plasma processing is performed in the air; however, this is not a limitation, and it may be performed in the atmosphere of gas, such as nitrogen or oxygen.

Furthermore, the plasma processing unit 10 that is illustrated in FIG. 1 uses the discharge electrode 11 that is rotatable to deliver the processed object 20 in a conveying direction; however, there is no limitation on this configuration. For example, one or more discharge electrodes may be used, which are movable in a direction that intersects with the conveying direction of the processed object 20.

Next, the plasma processing that is used according to the present embodiment is further explained in detail.

During the plasma processing, plasma irradiation is conducted on the processed object 20 in the air, whereby polymers on the surface of the processed object 20 are reacted, and a hydrophilic functional group is formed. Specifically, after an electron e is ejected from the discharge electrode, it is accelerated in the electric field, and atoms and molecules in the air are excited/ionized. Electrons are also ejected from the ionized atoms and molecules so that high-energy electrons are increased and, as a result, streamer discharge (plasma) is generated. By the high-energy electrons due to the streamer discharge, polymer binding (as the coated layer of coated paper is hardened by using calcium carbonate and starch as a binder, the starch has a polymer architecture) on the surface of the processed object 20 (e.g., coated paper) is broken, and it is recombined with the oxygen radical O*, the hydroxyl radical (—OH), or the ozone $O_3$ in the gas phase. Thus, a polar functional group of the hydroxyl, the carboxyl group, or the like, is formed on the surface of the processed object 20. As a result, the hydrophilic property or the acidic property is given to the surface of the processed object 20. Thus, the water contact angle of the surface of the processed object 20 is decreased so that the wetting property is improved and acidification (a decrease in the pH value) is obtained.

Furthermore, the acidification according to the present embodiment means decreasing the pH value of the processing-target surface of the processed object 20 to the pH value such that the pigments included in the ink are agglomerated. Decreasing the pH value means increasing the hydrogen ion $H^+$ concentration in the object. Before the pigments in the ink are brought into contact with the processing-target surface of the processed object 20, the pigments are negatively charged, and the pigments are spread in the vehicle.

Figure 2:
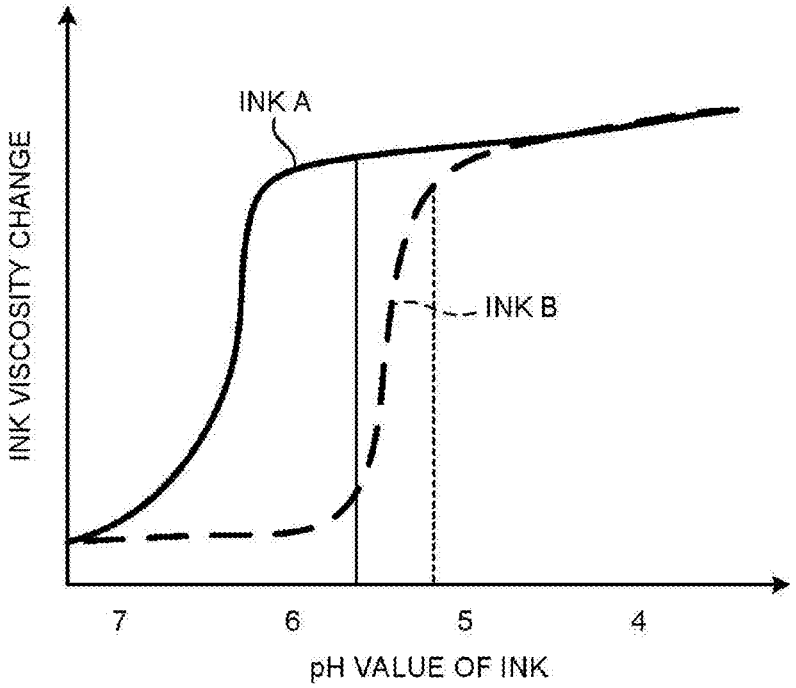
FIG. 2 is a graph that illustrates an example of the relation between the pH value of ink and the degree of viscosity of ink.

FIG. 2 is a graph that illustrates an example of the relation between the pH value of ink and the degree of viscosity of ink. As illustrated in FIG. 2, as the pH value of the ink is decreased, the degree of viscosity thereof is increased. This is because, as the degree of acidity of the ink is increased, the negatively-charged pigments in the vehicle of the ink are electrically neutralized and, as a result, the pigments are agglomerated. Therefore, the pH value of the surface of the processed object 20 is decreased so that the pH value of the ink becomes the value that corresponds to the required degree of viscosity in the graph that is illustrated in FIG. 2, for example, whereby the degree of viscosity of the ink can be increased. This is because, when the ink adheres to the processing-target surface of the processed object 20, the pigments are electrically neutralized by the hydrogen ion $H^+$ on the processing-target surface and, as a result, the pigments are agglomerated. Thus, it is possible to prevent a mixed color between adjacent dots and to prevent the pigment from deeply permeating the processed object 20 (further to the back surface). Furthermore, in order to decrease the pH value of the ink so that it becomes the pH value that corresponds to the required degree of viscosity, the pH value of the processing-target surface of the processed object 20 needs to be lower than the pH value of the ink that corresponds to the required degree of viscosity.

Furthermore, the pH value for obtaining the required degree of viscosity of ink is different depending on the characteristics of the ink. Specifically, like an ink A that is illustrated in FIG. 2, there are some inks for which the pigments are agglomerated at a relatively near-neutral pH value and the degree of viscosity is increased, meanwhile, like an ink B that has the different characteristics from the ink A, there are some inks for which the pH value lower than that for the ink A is needed to agglomerate the pigments.

The behavior of the pigment that is agglomerated in a dot, the speed at which a vehicle is dried, and the speed at which it permeates the processed object 20 are different depending on the amount of liquid drops that are changed due to the size of a dot (a small droplet, medium droplet, or large droplet), the type of the processed object 20, the type of ink, or the like. Therefore, in the following embodiment, the plasma energy amount during plasma processing may be controlled so as to be the optimum value in accordance with the type of the processed object 20, the amount of ink (the amount of liquid drops), the type of ink, or the like.

Figure 3:
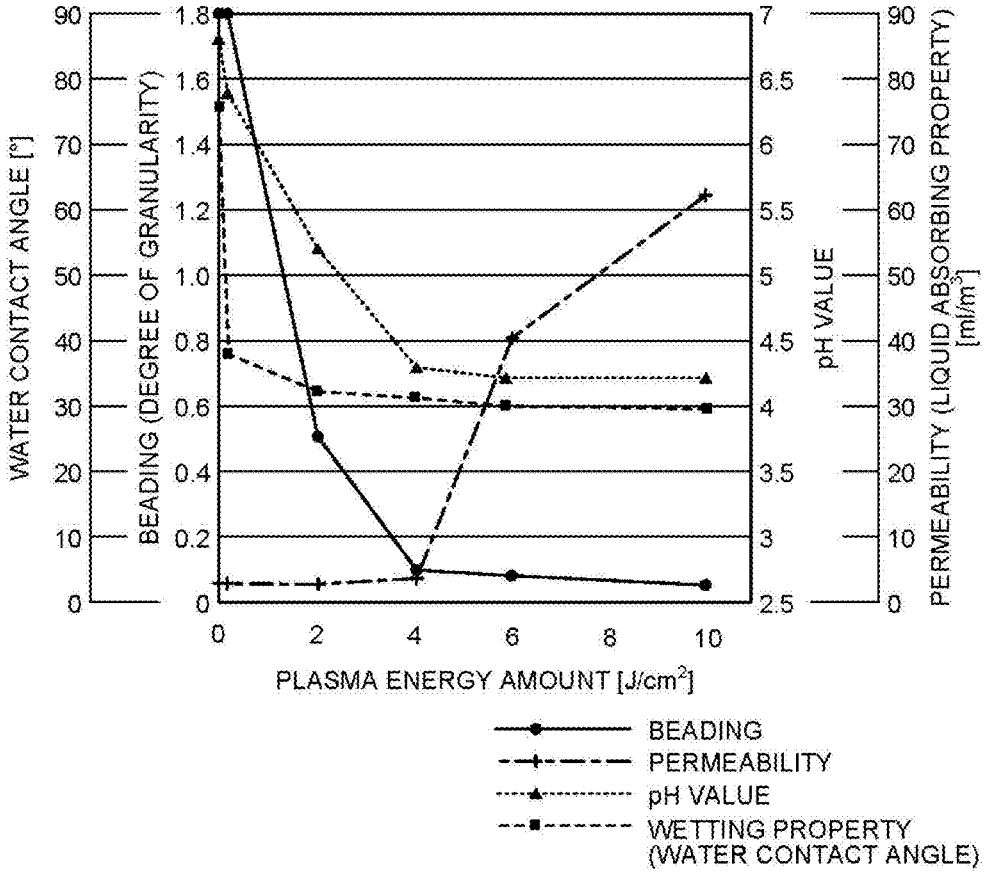
FIG. 3 is a graph that illustrates evaluation results.

FIG. 3 is a graph that illustrates the evaluation results of the plasma energy with the water contact angle (the wetting property) of the surface of the processed object, the beading, the pH value, and the permeability according to the present embodiment. FIG. 3 illustrates how the surface characteristics (the water contact angle (the wetting property), the beading, the pH value, and the permeability (liquid absorbing property)) changes depending on the plasma energy when printing is performed on coated paper as the processed object 20. Furthermore, to obtain the evaluations that are illustrated in FIG. 3, the used ink is water-based pigment ink (alkaline ink in which the negatively charged pigments are spread) that has the characteristics such that the pigments are agglomerated due to acid.

As illustrated in FIG. 3, the water contact angle of the surface of the coated paper is drastically decreased at a low plasma energy value (e.g., equal to or less than about 0.2 $J/cm^2$) (the wetting property is improved) and, even if the energy is further increased, the water contact angle is not much decreased. Meanwhile, the pH value of the surface of the coated paper is decreased to some extent as the plasma energy is increased. However, when the plasma energy exceeds a certain value (e.g., about 4 $J/cm^2$), a saturated state is generated. Furthermore, the permeability (the liquid absorbing property) is drastically improved when a decrease in the pH is saturated (e.g., about 4 $J/cm^2$). However, it is considered that this phenomenon is different depending on the polymer components that are included in ink.

As a result, it is clear that the value of the beading (the degree of granularity) enters an extremely good state after the permeability (the liquid absorbing property) starts to be improved (e.g., about 4 J/cm$^2$). Here, the beading (the degree of granularity) represents the degree of roughness of an image by using numerical values, and the variations in the density are represented by using the standard deviation of the average density. In FIG. 3, multiple densities of a solid color image that is formed of dots in two or more colors are sampled, and the standard deviation of the density is represented as the beading (the degree of granularity). When ink is discharged to coated paper on which plasma processing has been performed according to the present embodiment as described above, it is spread in an exact circle and is agglomerated while being permeated.

Furthermore, an improvement in the wetting property (a decrease in the water contact angle) of the surface of the processed object 20 or the acidification (a decrease in the pH) of the surface of the processed object 20 causes an improvement in the agglomeration or the permeability of ink pigments, permeation of the vehicle to the inner side of the coated layer, or the like. Thus, the density of pigments on the surface of the processed object 20 is increased; therefore, even if dots are combined, the pigments can be prevented from moving and, as a result, the pigments can be prevented from getting muddy, and the pigments can be uniformly settled down and agglomerated on the surface of the processed object.

Figure 4:
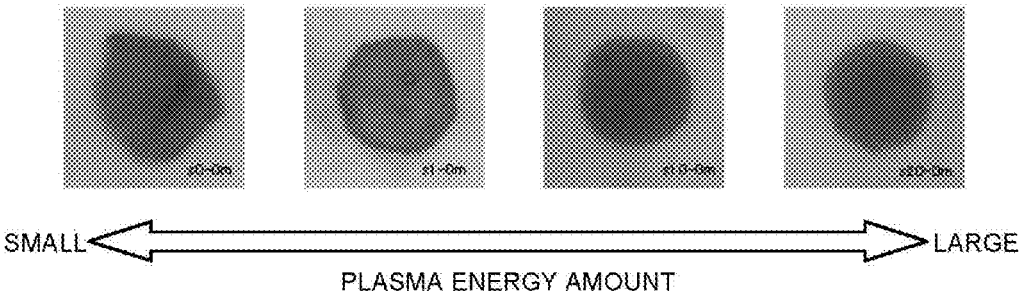
FIG. 4 is a diagram that illustrates observation results of the plasma energy amount and the evenness of agglomerated pigments.

FIG. 4 is a diagram that illustrates observation results of the plasma energy amount and the evenness of agglomerated pigments. As illustrated in FIG. 4, it is clear that, as the plasma energy amount is larger, the evenness of agglomerated pigments is improved.

Figure 5:
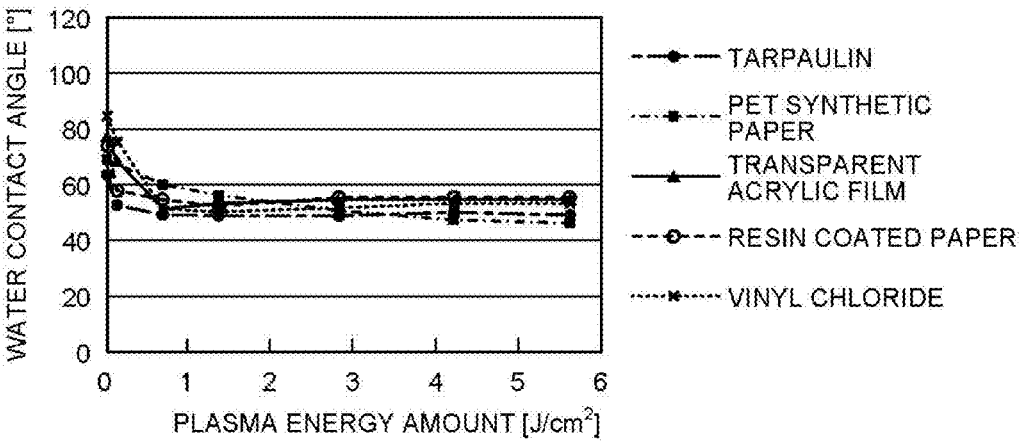
FIG. 5 is a graph that illustrates the measurement results of, with respect to pure water, the water contact angles of various types of impermeable recording media on which plasma processing is conducted.

FIG. 5 is a graph that illustrates the measurement results of, with respect to pure water, the water contact angles of various types of impermeable recording media on which plasma processing is conducted. In FIG. 5, the horizontal axis indicates the plasma energy. As illustrated in FIG. 5, it is clear that, even in the case of an impermeable recording medium, plasma processing causes a decrease in the water contact angle and an improvement in the wetting property. In the case of a water-based pigment ink, as the surface tension thereof is low compared to the case of pure water, it is considered that it gets wet more easily. Specifically, a water-based pigment ink is thinly spread and wet in an easy manner due to plasma processing and, as a result, the obtained surface condition is effective for evaporating moisture.

Furthermore, an explanation is given below of vinyl chloride; however, as indicated by the above results, the modification effect of plasma processing is also observed with regard to an impermeable recording medium that is made of a thermoplastic resin, such as polyester or acrylic.

Here, the inventors have found out that, as the temperature of the surface of the processed object 20, on which plasma processing has been performed, is increased, the modification effect of plasma processing is reduced.

Figure 6:
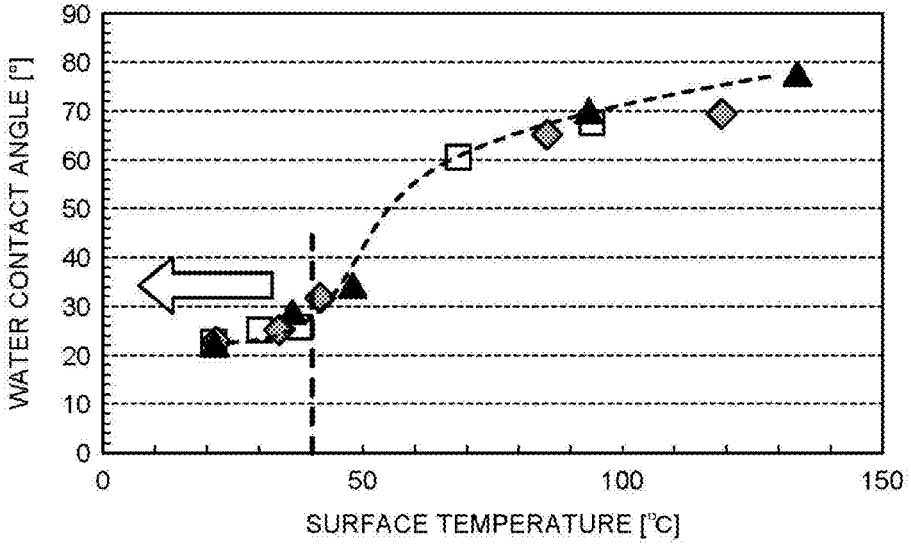
FIG. 6 is a graph that illustrates the relation between the surface temperature of a processed object and the water contact angle with respect to pure water.

FIG. 6 is a graph that illustrates the relation between the surface temperature of the processed object 20 and the water contact angle with respect to pure water.

Specifically, FIG. 6 illustrates the relation between the surface temperature and the water contact angle in a case where LumiArtGloss paper, which is offset coated paper, is used as the processed object 20 and the plasma energy amount of the discharge plasma is 7 kJ/m$^2$. Furthermore, the water contact angle of the offset coated paper is about 70° before plasma processing is performed under the above condition. Furthermore, the water contact angle of the offset coated paper is about 24° after plasma processing is performed under the above condition, i.e., a significantly low water contact angle is obtained. The surface of the offset coated paper is heated with hot air whose temperature is set to each temperature standard by using a heat gun, the time during which the hot air is applied is set as a standard, and the surface temperature at that point is measured by a thermometer. Then, the water contact angle of the surface of each offset coated paper that is heated at each temperature is measured.

According to the present embodiment, the measurement of the water contact angle is conducted by using a contact angle meter (manufactured by Kyowa Interface Science Co., Ltd.: PCA-1) and, under the environment of 50% RH, pure water of 1 μl is dropped onto the surface of the processed object 20, and the contact angle is obtained after 1,000 ms.

Although the water contact angle of the offset coated paper right after plasma processing is about 24°, the water contact angle is increased as the surface temperature of the offset coated paper becomes higher, as illustrated in FIG. 6. Specifically, after the water contact angle of the offset coated paper, on which modification processing has been performed during plasma processing, becomes about 24°, the water contact angle is drastically increased by equal to or greater than 30° at the surface temperature of nearly 40 degrees.

Figure 7:
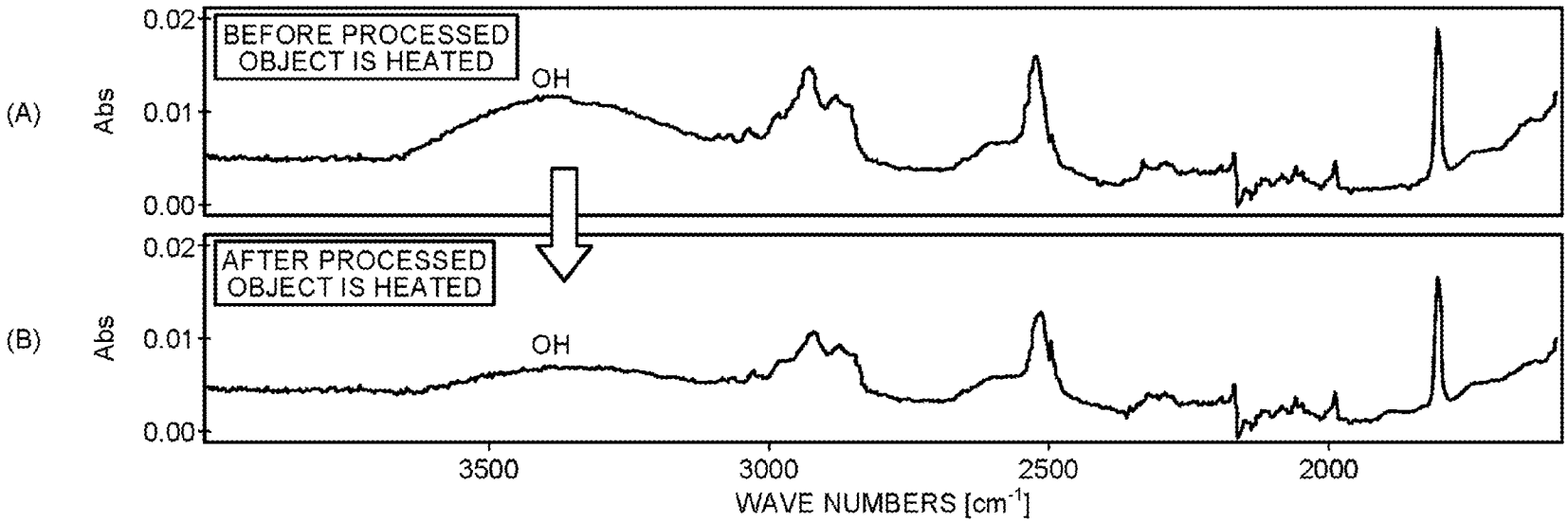
FIG. 7 is a graph that illustrates the measurement results of FT-IR before and after heat is applied to the processed object on which plasma processing has been performed.

Furthermore, FIG. 7 is a graph that illustrates the measurement results of FT-IR before and after heat is applied to the processed object 20 on which plasma processing has been performed.

Specifically, FIG. 7 indicates the measurement result of the FT-IR (infrared spectrometer) in a case where LumiArtGloss paper, which is offset coated paper, is used as the processed object 20 and modification processing is conducted on the surface of the offset coated paper during plasma processing.

FIG. 7(A) illustrates the measurement result of the offset coated paper right after the plasma processing by using the FT-IR. FIG. 7(B) illustrates the measurement result of the offset coated paper, to which heat is applied after the plasma processing, by using the FT-IR.

As illustrated in FIG. 7(A) and FIG. 7(B), if heat is applied to the processed object 20 on which plasma processing has been performed, the peak of the hydroxyl (—OH) is lowered compared to that before the heat is applied. This result indicates that the hydroxyl (—OH), which is coordinated due to plasma processing, is decreased due to the heat, and therefore it means that the wetting property is reduced and the water contact angle is increased.

Furthermore, the inventors have found out that, if heat is applied to the processed object 20 on which plasma processing has been conducted, a hydrophilic functional group, such as the hydroxyl (OH), the carbonyl group (>C=0), or the aldehyde group (—CHO), which is generated due to discharge plasma, is separated from the processed object 20 due to the heat. Specifically, the inventors have found out that the separation of the hydrophilic functional group due to the heat causes an increase in the water contact angle, which has been decreased during plasma processing, and the modification effect is reduced. Furthermore, the inventors have found out that, according to the result of FIG. 7, the separation of the hydroxyl (OH) due to the heat causes an increase in the pH, which has been decreased during plasma processing, and the modification effect is reduced.

Figure 8:
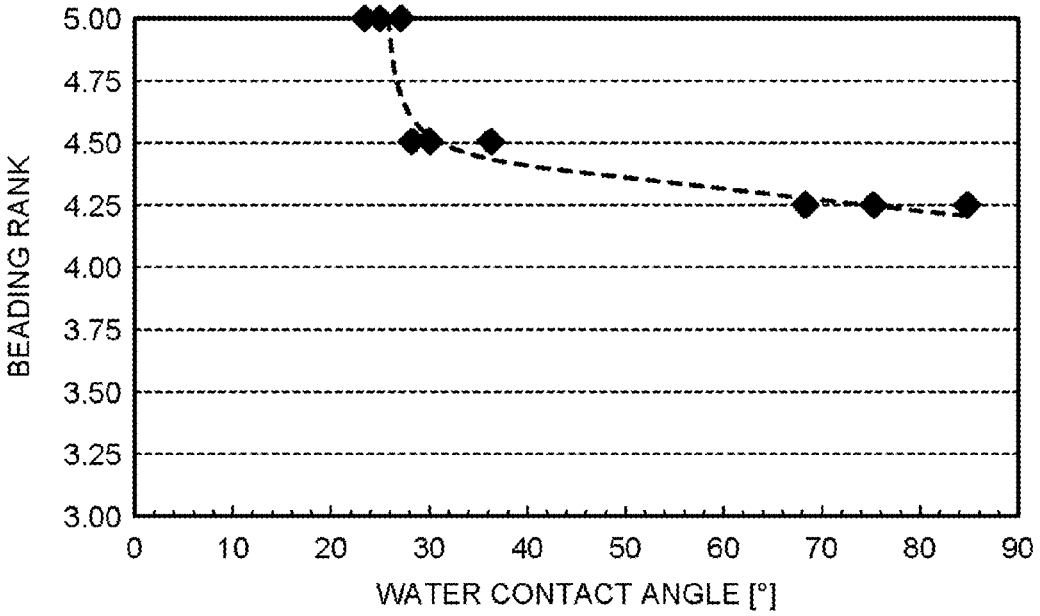
FIG. 8 is a graph that illustrates the relation between the water contact angle and the beading rank.

FIG. 8 is a graph that illustrates the relation between the water contact angle and the beading rank.

Specifically, FIG. 8 illustrates the measurement results of the relation between the water contact angle and the beading rank by using LumiArtGloss paper, which is offset coated paper, as the processed object 20. The beading rank is obtained by ranking, for the organoleptic evaluation, the phenomena that degrades the quality of images that are formed by dots due to the occurrence of an irregular space between dots, an increase in the density, or the like, when adjacent dots (dots due to ink droplets) are connected on the processed object 20. A higher beading rank indicates a finer image quality.

As illustrated in FIG. 8, in order to obtain a high image quality of equal to or greater than the beading rank 4.75, the water contact angle of the surface of the processed object 20 (here, the offset coated paper) needs to be equal to or less than 30°. Furthermore, the specification of the beading rank is defined for each product (each type of the processed object 20 that is the target to be processed or each printed material (the processed object 20 on which images are formed by using ink) that is the target).

Furthermore, FIG. 8 illustrates the graph of the results that indicate the relation between the water contact angle and the beading rank. As described above, to improve the beading, the pH value of the surface of the processed object 20 is relevant. According to the present embodiment, there is an issue of heat that affects the modification effect that is given to the processed object 20 during plasma processing. Therefore, an explanation is omitted for the pH value with which there are not much effects of heat.

As illustrated in FIG. 6 to FIG. 8, the inventors have found out that the effect of heat decreases the modification effect that is given to the processed object 20 during plasma processing. Specifically, it has been found out that a higher surface temperature of the processed object 20 increases the water contact angle and the pH value that have been decreased during plasma processing.

During the discharge to perform plasma processing, heat is generated. This is because the discharge electrode 11 and the earth electrode 14 are heated during the discharge. Conventionally, no consideration is given to the effect of heat that is applied to the processed object 20 during plasma processing. Therefore, conventionally, the modification effect, which is given to the processed object 20 during plasma processing, is decreased due to heat. Specifically, the ink is discharged to the surface of the processed object 20 on which plasma processing has been conducted, the modification effect is reduced due to the effect of heat, and the image quality is degraded. Specifically, the effect of heat conventionally causes a reduction in the modification effect, such as an increase in the water contact angle that has been decreased during plasma processing, or an increase in the pH that has been decreased during plasma processing.

Therefore, according to the present embodiment, the modification device, which includes the plasma processing unit 10, includes a cooling unit. The cooling unit cools the surface of the processed object at least from when plasma processing is performed to when the ink is discharged so that the surface temperature of the processed object during discharge of the ink to processed object is a temperature at which the target water contact angle range is achieved. Furthermore, the water contact angle that is the target is referred to as the target water contact angle in the following explanation.

According to the present embodiment, the modification device is configured to include the above-described cooling unit; therefore, it is possible to prevent an increase in the water contact angle that has been reduced during plasma processing and to prevent degradation in the modification effect. Furthermore, according to the present embodiment, as degradation in the modification effect can be prevented, it is possible to prevent an image quality degradation of the image that is formed by discharging the ink onto the surface of the processed object 20 on which plasma processing has been performed. Furthermore, as the modification device according to the present embodiment includes the above-described cooling unit, it is possible to produce the effects, such as an improvement in the color of the ink that is discharged to the processed object on which the modification processing has been performed, dot expansion due to an improvement in the wetting property, or a reduction in the amount of adhering ink.

Next, a detailed explanation is given of a printing system according to the present embodiment.

Figure 9:
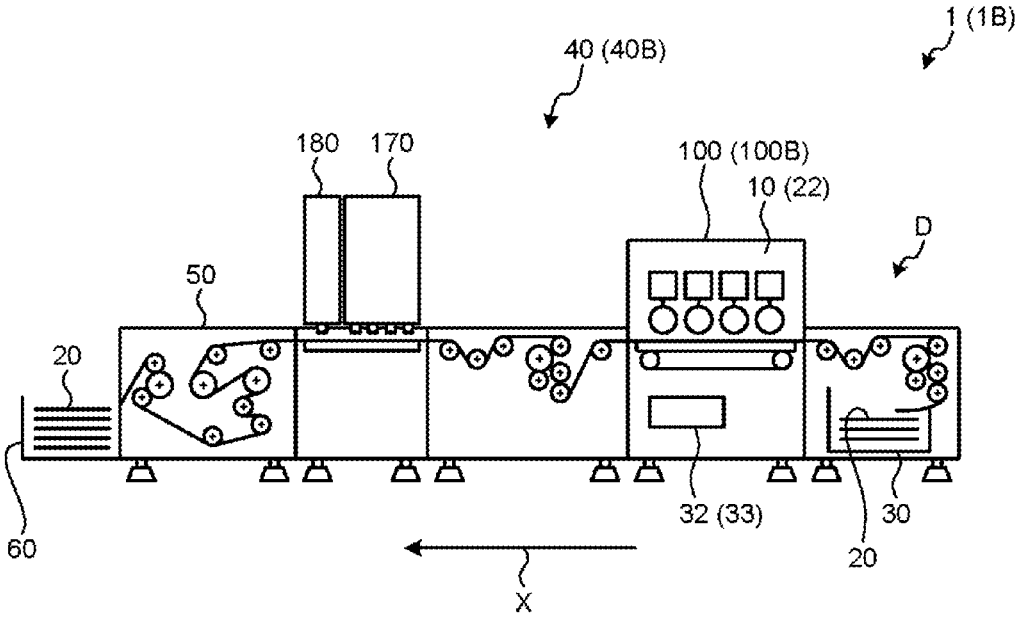
FIG. 9 is a schematic diagram that illustrates a schematic configuration of a printing system according to the present embodiment.

FIG. 9 is a schematic diagram that illustrates a schematic configuration of a printing system 1 according to the present embodiment. The printing system 1 includes an image forming apparatus 40. The image forming apparatus 40 includes a storage unit 30, a modification device 100, a recording unit 170, a drying unit 50, and a discharge unit 60. Here, the image forming apparatus 40 may be configured to include at least the modification device 100 and the recording unit 170.

The storage unit 30 stores the processed object 20 that is the target to be processed. The processed object 20 that is handled by the printing system 1 may be cut paper that is cut into a predetermined size or may be a roll of paper. A roll of paper is, for example, continuous paper (fanfold paper or continuous business form) on which cuttable perforations are formed at a predetermined interval. In this case, a page in a roll of paper is, for example, an area that is sandwiched between perforations with a predetermined interval.

In the printing system 1, multiple conveyance rollers are provided. The conveyance roller sequentially conveys the processed objects 20, which are stored in the storage unit 30, on a conveyance path D in a conveying direction X.

The modification device 100 includes the plasma processing unit 10, a cooling unit 22, and a control unit 32 (the details are given later). After the processed object 20 is subjected to plasma processing by the modification device 100, it is conveyed along the conveyance path D in the conveying direction X so as to reach the recording unit 170.

The recording unit 170 discharges the ink to form an image. The recording unit 170 is a known inkjet recording device. For example, the recording unit 170 includes discharge heads of four colors, i.e., black (K), cyan (C), magenta (M), and yellow (Y). Furthermore, each of the discharge heads discharges the ink of each color (black, cyan, magenta, or yellow). Here, there is no limitation on the configuration such that the recording unit 170 includes the discharge heads of four colors. The recording unit 170 may be configured to include the discharge head of one or more colors.

There is no limitation on the type of ink that is discharged by the recording unit 170. For example, the ink to be used includes the pigment (for example, about 3 wt %), a small amount of surface active agent, a styrene-acrylic resin (for example, a particle diameter of 100 nm to 300 nm) (for example, about 5 wt %), various types of additive preservative agents, a mildew-proofing agent, a pH adjuster, a dye solubilizing agent, antioxidant, a conductivity adjuster, a surface tension adjuster, an oxygen absorber, or the like, which are dispersed in an organic solvent (e.g., an ether-type and diol-type solvent) (for example, about 50 wt %).

Furthermore, instead of a styrene-acrylic resin, it is possible to use a hydrophobic resin, such as an acrylic resin, vinyl acetate resin, styrene-butadiene resin, vinyl chloride resin, butadiene resin, or styrene resin. Moreover, it is preferable that, with regard to any of the resins, the molecular weight is relatively low and an emulsion is formed.

Furthermore, it is preferable that glycols are added to the ink as the component for effectively preventing nozzle clogging. The added glycols include, for example, ethylene glycol, diethylene glycol, triethylene glycol, propylene glycol, dipropylene glycol, tripropylene glycol, polyethylene glycol with a molecular weight of equal to or less than 600, 1,3-propylene glycol, isopropylene glycol, isobutylene glycol, 1,4-butanediol, 1,3-butanediol, 1,5-pentanediol, 1,6-hexanediol, glycerin, meso-erythritol, or pentaerythritol. Furthermore, it includes elemental substances and mixtures, such as a different thiodiglycol, 1,4-butanediol, 1,5-pentanediol, 1,6-hexanediol, propylene glycol, dipropylene glycol, tripropylene glycol, neopentyl glycol, 2-methyl-2,4-pentanediol, trimethylol propane, or trimethylolethane.

Preferred examples of the organic solvent include ethanol, methanol, butanol, propanol, 1- to 4-carbon alkyl alcohols, such as isopropanol, ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxy butanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, glycol ethers, such as dipropylene glycol mono-iso-propyl ether, formamide, acetamide, dimethyl sulfoxide, sorbit, sorbitan, acetin, diacetin, triacetin, sulfolane, pyrrolidone, N-methyl pyrrolidone, or the like.

Furthermore, the major ingredient of ink may be water. If the ink does not use an organic solvent, monomer, or oligomer, it is not necessary to select an ink cartridge or a supply path that is formed of a special material, and therefore the configuration of the device can be simplified.

The type of ink is determined depending on the mixture ratio of the above materials that are included in the ink or the type of included component.

The recording unit 170 is located downstream of the modification device 100 (the plasma processing unit 10) in the conveying direction X. Therefore, the recording unit 170 is located at a position where it can discharge the ink to the processed object 20 on which plasma processing has been performed.

Furthermore, the printing system 1 may be configured such that a post-processing unit 180 is additionally located downstream of the recording unit 170 in the conveying direction X. The post-processing unit 180 may be a device that performs known post-processing on the processed object 20 to which the ink has been discharged.

The drying unit 50 is located downstream of the recording unit 170 in the conveying direction X. The drying unit 50 dries the ink that has been discharged to the processed object 20. The discharge unit 60 is located downstream of the drying unit 50 in the conveying direction X. The processed object 20 on which plasma processing has been performed and to which the ink has been discharged (an image has been formed) is discharged into the discharge unit 60.

The printing system 1 further includes the control unit 32 that controls each unit of the devices of the printing system 1. Here, the control unit 32 does not need to be configured by using a single computer, and it may be configured by connecting multiple computers via a network, such as a local area network (LAN). Moreover, the control unit 32 may be configured to include a control unit that is individually provided in each unit of the printing system 1.

Furthermore, each unit (device) included in the printing system 1 may be located in a separate chassis so that the printing system 1 is configured in its entirety, or the printing system 1 may be configured as being housed in the same chassis.

Figure 10:
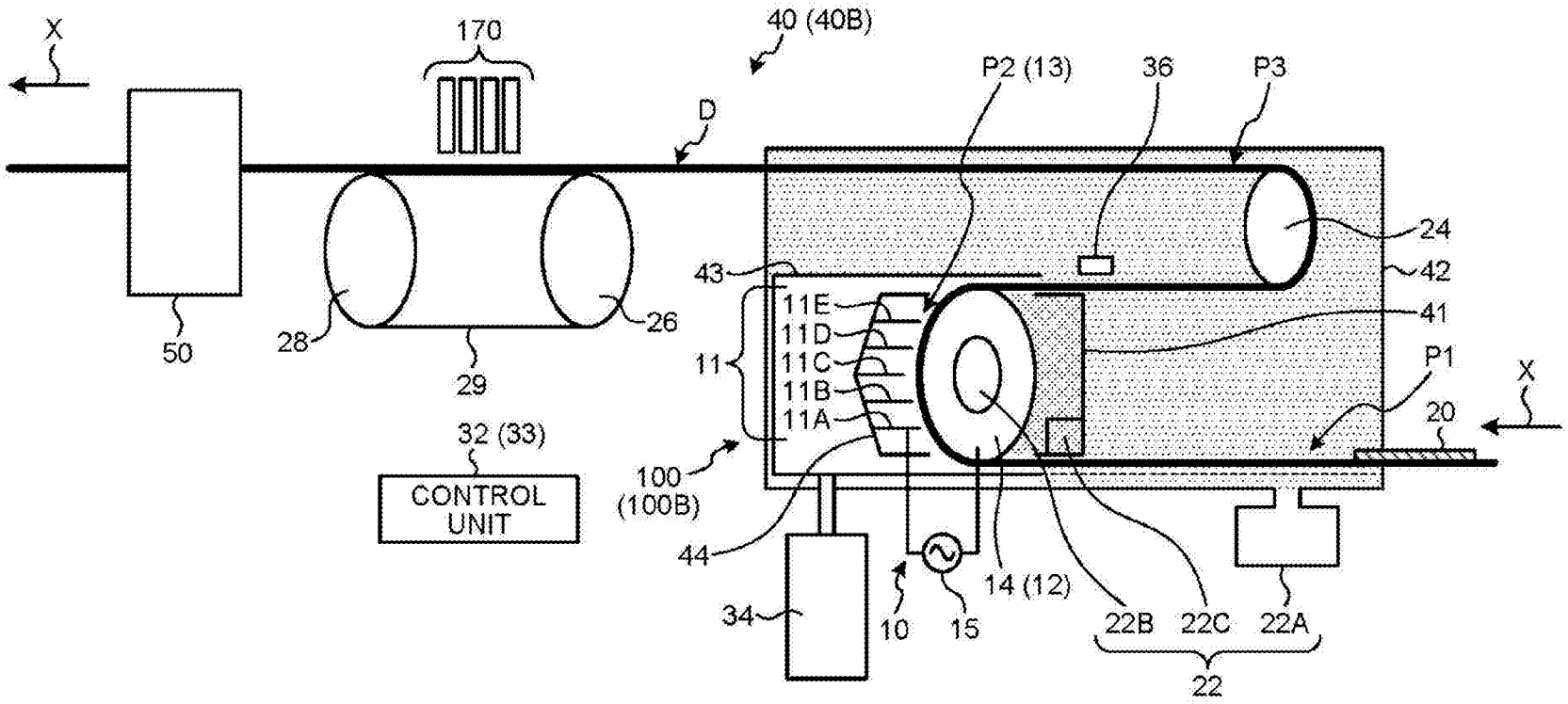
FIG. 10 is a detailed explanatory diagram of the printing system.

FIG. 10 is a detailed explanatory diagram of the printing system 1.

As illustrated in FIG. 10, the printing system 1 includes the image forming apparatus 40 and the drying unit 50. The image forming apparatus 40 includes the recording unit 170 and the modification device 100.

The modification device 100, the recording unit 170, and the drying unit 50 are located in this order along the conveyance path D from the upstream side toward the downstream side in the conveying direction X. The printing system 1 is provided with multiple conveyance rollers (a conveyance roller 24, a conveyance roller 26, a conveyance roller 28, or the like) that convey the processed object 20 along the conveyance path D. The conveyance rollers convey the processed object 20 from the upstream side toward the downstream side in the conveying direction X along the conveyance path D.

The modification device 100 includes the plasma processing unit 10, the cooling unit 22, and the control unit 32.

The plasma processing unit 10 performs plasma processing on the processed object 20 so that the surface of the processed object 20 has a predetermined water contact angle. The predetermined water contact angle is obtained by plasma processing, and it is the water contact angle of the surface of the processed object 20 right after the plasma processing. The predetermined water contact angle is previously set by, for example, a user.

As described above (see FIG. 1), the plasma processing unit 10 includes the discharge electrode 11, the earth electrode 14, the dielectric 12, and the voltage applying unit 15. Furthermore, as illustrated in FIG. 1, a space is provided between the discharge electrode 11 and the dielectric 12. When the processed object 20 is conveyed from the upstream side in the conveying direction X in the plasma processing unit 10, it reaches the space between the discharge electrode 11 and the dielectric 12 so that the surface of the processed object 20 is subjected to plasma processing.

Here, FIG. 1 and FIG. 10 illustrate a case where dielectric barrier discharge is used as plasma processing; however, if corona discharge is used, the dielectric 12 may be omitted.

The voltage applying unit 15 applies the discharge (plasma processing) pulse voltage to the discharge electrode 11, thereby generating the non-equilibrium atmospheric pressure plasma 13 between the discharge electrode 11 and the earth electrode 14. After the processed object 20 is conveyed between the discharge electrode 11 and the earth electrode 14 (the dielectric 12), it is brought into contact with the non-equilibrium atmospheric pressure plasma 13 when it is passed between the discharge electrode 11 and the earth electrode 14 (the dielectric 12), whereby the surface thereof is subjected to plasma processing.

The plasma energy amount that is applied during the plasma processing is adjusted by using the frequency of the pulse voltage that is fed to the discharge electrode 11 from the voltage applying unit 15, the voltage value, the number of the discharge electrodes 11 that apply the voltage, the voltage application time, or the like.

Specifically, the voltage applying unit 15 is controlled by the control unit 32 that is described later so that the plasma energy amount is adjusted. That is, the control unit 32 controls the voltage applying unit 15 so as to obtain a predetermined water contact angle of the surface of the processed object 20, thereby adjusting the plasma energy amount.

For example, the discharge electrode 11 is configured by using the multiple discharge electrodes 11 (discharge electrode 11A to discharge electrode 11E). Furthermore, to obtain the plasma energy amount so as to obtain the predetermined water contact angle, the voltage applying unit 15 drives the required number of the discharge electrodes 11 (the discharge electrode 11A to the discharge electrode 11E) and adjusts the value of the voltage that is applied to each of the discharge electrodes 11 (the discharge electrode 11A to the discharge electrode 11E), the voltage application time, or the like. Furthermore, the plasma processing may be adjusted by a humidity adjusting mechanism that is provided in the modification device 100 (Japanese Patent Application Laid-open No. 2013-199017). Here, there is no limitation on the method for adjusting the plasma energy amount, and it is possible to appropriately make changes for a method with the combination of the above, different methods, or the like.

Here, if the modification device 100 is configured to include the discharge electrodes 11 (the discharge electrode 11A to the discharge electrode 11E), it is effective for the uniform acidification on the surface of the processed object 20. Specifically, if the conveying speed (or the printing speed) is the same, for example, it is possible to increase the time during which the processed object 20 passes through the plasma space in a case where plasma processing is performed by using the multiple discharge electrodes 11, compared to a case where plasma processing is performed by using the single discharge electrode 11. As a result, plasma processing can be performed further uniformly on the surface of the processed object 20.

Here, FIG. 10 (and FIG. 1) illustrates an example of the configuration such that the discharge electrode 11 is located away by about several millimeters from the processed object 20 that passes between the discharge electrode 11 and the earth electrode 14 (the dielectric 12). However, there is no limitation on the configuration. For example, a configuration may be such that the discharge electrode 11 is a roller electrode that is circular in cross-section and it is rotated together with the processed object 20 while being in contact with the processed object 20 when the processed object 20 passes between the discharge electrode 11 and the dielectric 12 (the earth electrode 14). Furthermore, a thin electrode, such as a wire electrode or a blade electrode, may be used as the discharge electrode 11.

FIG. 10 illustrates a case where the earth electrode 14, which is located opposite to the discharge electrode 11, has a roll shape.

According to the present embodiment, the earth electrode 14, which is formed into a roll shape, is provided such that it is rotatable in the conveying direction X by an undepicted conveying mechanism. Therefore, after the processed object 20 is conveyed in the conveying direction X from the side that is located upstream of the plasma processing unit 10 in the conveying direction X and reaches the area between the discharge electrode 11 and the earth electrode 14, the processed object 20 is conveyed in accordance with the rotation of the earth electrode 14 while it is subjected to plasma processing, and it is discharged to the side that is located downstream of the plasma processing unit 10 in the conveying direction X.

According to the present embodiment, the plasma processing unit 10 is provided within a first chassis 42 that covers a first area P1, a second area P2, and a third area P3.

The first area P1 is the area that is on the conveyance path D of the processed object 20 and that is located upstream of the plasma processing unit 10 in the conveying direction X of the processed object 20. The second area P2 is the area that is on the conveyance path D and in which plasma processing is performed by the plasma processing unit 10. That is, the second area P2 is the area between the discharge electrode 11 and the earth electrode 14 (the dielectric 12). The third area P3 is the area that is on the conveyance path D, is located downstream of the plasma processing unit 10 in the conveying direction X of the processed object 20, and continues until before the recording unit 170 discharges the ink.

Therefore, the first chassis 42 covers the first area P1, the second area P2, and the third area P3, and the plasma processing unit 10 is provided inside the first chassis 42.

A third chassis 43, a second chassis 41, and a fourth chassis 44 are further provided inside the first chassis 42. The third chassis 43 is provided outside the plasma processing unit 10 such that it covers the discharge electrode 11 and the second area P2. The second chassis 41 is provided such that it covers the area that is on the outer circumference of the roll-shaped earth electrode 14 and that is opposite to the discharge electrode 11. The fourth chassis 44 has a function to prevent releasing of active species (oxygen radical, or the like) that are generated due to the discharge of the discharge electrode 11, and it affects the modification effect of the processed object 20. The third chassis 43 shields the electromagnetic waves that are generated by the discharge electrode 11 or prevents external leakage of ozone, or the like, that is generated due to the discharge.

Furthermore, each of the first chassis 42, the second chassis 41, the third chassis 43, and the fourth chassis 44 is located at a position so as not to interfere with the conveyance of the processed object 20 on the conveyance path D.

Furthermore, the plasma processing unit 10 is provided with an ozone processing unit 34. The ozone processing unit 34 is provided outside the third chassis 43. The ozone processing unit 34 communicates with the inside of the third chassis 43 via a hole section (not illustrated) that passes through the first chassis 42 and the third chassis 43. The ozone processing unit 34 processes the ozone that is generated during plasma processing by the plasma processing unit 10. The ozone processing unit 34 may be a mechanism that discharges the ozone in a harmless state to the external air. For example, a known ozone processing device is used as the ozone processing unit 34.

The cooling unit 22 cools the surface of the processed object 20 at least from when plasma processing is performed to when the ink is discharged so that the surface temperature of the processed object 20 during the discharge of the ink to the processed object 20 is a temperature at which the target water contact angle range is achieved. The target water contact angle is the target water contact angle of the processed object 20 just before the ink is discharged. The target water contact angle is previously set by a user. The target water contact angle is a value equal to or less than the above-described predetermined water contact angle. Specifically, the cooling unit 22 cools the processed object 20 at least during the period from when the plasma processing unit 10 performs plasma processing to when the recording unit 170 discharges the ink so that the surface temperature of the processed object 20 during the discharge of the ink to the processed object 20 is a temperature at which the target water contact angle range is achieved. Furthermore, the temperature at which the target water contact angle range is achieved indicates the temperature range in which the surface of the processed object 20 can retain the target water contact angle.

The cooling unit 22 cools the processed object 20 by directly cooling the processed object 20 or by cooling the air or a member that is in contact with the processed object 20.

According to the present embodiment, the cooling unit 22 cools the air within the first chassis 42, thereby cooling at least one of the first area P1, the second area P2, and the third area P3. Thus, the cooling unit 22 cools the surface of the processed object 20 at least from when plasma processing is performed to when the ink is discharged.

Specifically, the cooling capability of the cooling unit 22 is adjusted by the control unit 32 (the details are given later). Due to the adjustment of the cooling capability by the control unit 32, the cooling unit 22 cools the surface of the processed object 20 at least from when plasma processing is performed to when the ink is discharged so that the surface temperature of the processed object 20 during the discharge of the ink to the processed object 20 is a temperature at which the target water contact angle range is achieved.

According to the present embodiment, the cooling unit 22 includes a first cooling unit 22A, a second cooling unit 22B, and a third cooling unit 22C. Here, the cooling unit 22 may be configured to include at least one of the first cooling unit 22A, the second cooling unit 22B, and the third cooling unit 22C.

The first cooling unit 22A cools the first area P1 and the third area P3. The first cooling unit 22A communicates with the inside of the first chassis 42 via a hole section (not illustrated) that is provided in the first chassis 42 so as to cool the air within the first chassis 42. Thus, the first cooling unit 22A cools the first area P1 and the third area P3, which are the areas inside the first chassis 42. The first cooling unit 22A may be appropriate as long as it is a device that is capable of cooling the air within the first chassis 42.

Furthermore, the third chassis 43 and the second chassis 41, which are provided inside the first chassis 42, are configured to prevent the air within the first area P1 from directly flowing into the area (the area for performing plasma processing on the processed object 20) between the discharge electrode 11 and the earth electrode 14. Thus, it is possible to prevent variations of plasma processing, or the like, due to the air flowing into the area for plasma processing from outside the area.

The second cooling unit 22B cools the inner side of the earth electrode 14, thereby cooling the second area P2. For example, the second cooling unit 22B is configured to include a rod-like cooling mechanism in the central part of the earth electrode 14, thereby cooling the inner side of the earth electrode 14. Here, the second cooling unit 22B may be appropriate as long as it is configured to cool the inner side of the earth electrode 14, and there is no limitation on the configuration. For example, the second cooling unit 22B may use any method, such as an air cooling method or an oil cooling method.

As described above, the second cooling unit 22B cools the inner side of the earth electrode 14 instead of directly flowing the cooled air into the second area P2, thereby cooling the second area P2. Thus, the second cooling unit 22B can prevent variations of plasma processing due to the air flowing into the second area P2, i.e., the area in which plasma processing is performed, from outside the area, thereby cooling the second area P2. Furthermore, the second cooling unit 22B cools the earth electrode 14 so as to cool the processed object 20 in the process of plasma processing and can prevent an increase in the temperature of the processed object 20.

The third cooling unit 22C cools the outer side of the earth electrode 14, thereby cooling the second area P2. According to the present embodiment, the third cooling unit 22C cools the air in the area that is surrounded by the second chassis 41 outside the earth electrode 14. Specifically, the third cooling unit 22C cools the air in the area that is on the outer circumference of the earth electrode 14 and that is on the opposite side of the discharge electrode 11. Here, the third cooling unit 22C may be appropriate as long as it is configured to cool the outer side of the earth electrode 14, and there is no limitation on the configuration.

As described above, the third cooling unit 22C cools the outer side (and the opposite side of the discharge electrode 11) of the earth electrode 14 instead of directly flowing the cooled air into the second area P2, thereby cooling the second area P2. Thus, the third cooling unit 22C prevents variations of plasma processing due to the air flowing into the second area P2, i.e., the area in which plasma processing is performed, from outside the area, thereby cooling the second area P2. Furthermore, the third cooling unit 22C cools the earth electrode 14 to cool the processed object 20 in the process of plasma processing, thereby preventing an increase in the temperature of the processed object 20.

Specifically, the third cooling unit 22C and the second cooling unit 22B have functions to prevent an increase in the temperature of the earth electrode 14 due to the heat that is generated during plasma processing and to prevent an increase in the temperature of the processed object 20 that is conveyed between the earth electrode 14 and the discharge electrode 11.

Under the control of the control unit 32, adjustments are made to the cooling capacity of each of the first cooling unit 22A, the second cooling unit 22B, and the second cooling unit 22B and to the arbitrary cooling unit 22 (the first cooling unit 22A, the second cooling unit 22B, or the third cooling unit 22C) to be driven.

The modification device 100 further includes a detecting unit 36. The detecting unit 36 detects the surface temperature of the processed object 20 that is conveyed on the conveyance path D. The detecting unit 36 may be appropriate as long as it is a device that is capable of detecting the surface temperature of the processed object 20. Furthermore, it is preferable to use, as the detecting unit 36, a known device that is capable of detecting the surface temperature of the processed object 20 in a non-contact manner. Furthermore, it is preferable that the detecting unit 36 is located at a position where it is capable of detecting the surface of the processed object 20 on which plasma processing has been performed and it is capable of detecting the surface temperature of the processed object 20 in a non-contact manner.

On the conveyance path D, the detecting unit 36 may be located upstream of the recording unit 170 on the conveyance path D in the conveying direction X of the processed object 20. Furthermore, it is preferable that the detecting unit 36 is located upstream of the recording unit 170 on the conveyance path D in the conveying direction X of the processed object 20 and is located downstream of the plasma processing unit 10 in the conveying direction X. Moreover, it is especially preferable that the detecting unit 36 is located upstream of the recording unit 170 on the conveyance path D in the conveying direction X of the processed object 20, is located downstream of the plasma processing unit 10 in the conveying direction X, and is located at a position where the surface temperature of the processed object 20 right after the plasma processing by the plasma processing unit 10 can be detected. Specifically, the position where the surface temperature of the processed object 20 right after the plasma processing by the plasma processing unit 10 can be detected is a position that is connected to the area that is opposed to the discharge electrode 11 and the earth electrode 14 on the conveyance path D and that is located downstream of the opposed area in the conveying direction X, or a position that is closest to the position and on which the detecting unit 36 can be installed.

After the processed object 20 is subjected to plasma processing by the plasma processing unit 10 and is cooled by the cooling unit 22, it is conveyed by multiple conveyance rollers (the conveyance roller 24, or the like) and reaches the recording unit 170.

The recording unit 170 discharges the ink to the surface of the processed object 20 on which plasma processing has been performed and which is conveyed to the recording unit 170. As the ink is discharged, an image is formed on the processed object 20. After the image is formed on the processed object 20, the processed object 20 is conveyed by a conveyance belt 29 that is conveyed while being supported from the inner side by the conveyance roller 28 and the conveyance roller 26 so that it reaches the drying unit 50. After the processed object 20 reaches the drying unit 50, the surface of the processed object 20 is dried by the drying unit 50, and it is discharged into the discharge unit 60 (not illustrated in FIG. 10).

Next, the control unit 32 is explained.

Figure 11:
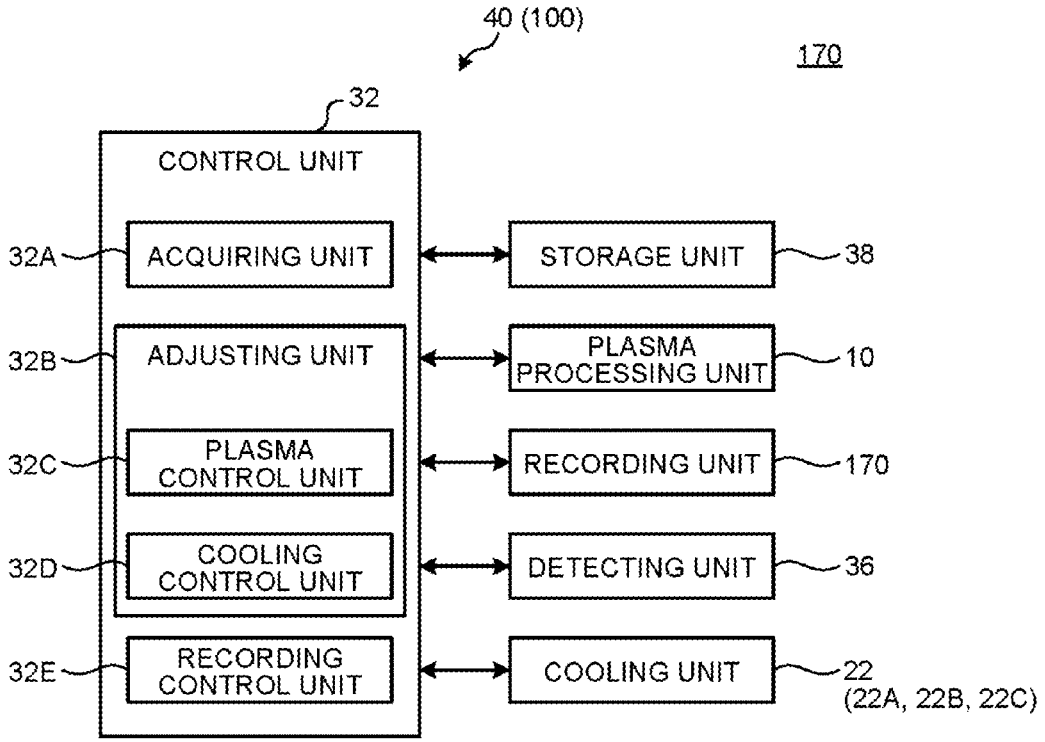
FIG. 11 is a functional block diagram of a control unit.

FIG. 11 is a functional block diagram of the control unit 32. The control unit 32 includes an acquiring unit 32A, an adjusting unit 32B, and a recording control unit 32E. The adjusting unit 32B includes a plasma control unit 32C and a cooling control unit 32D. All or some of the acquiring unit 32A, the plasma control unit 32C, the cooling control unit 32D, and the recording control unit 32E may be implemented by, for example, causing a processing device, such as a central processing unit (CPU), to execute a program, i.e., by using software, may be implemented by using hardware, such as an integrated circuit (IC), or may be implemented by using software and hardware in combination.

In the present embodiment, an explanation is given based on the assumption that the control unit 32 controls the image forming apparatus 40. Furthermore, the control unit 32 may be configured to include, as separate units, a control unit that controls the modification device 100, a control unit that controls the recording unit 170, and a control unit that controls each of the other components that are provided in the image forming apparatus 40. In this case, the control unit that controls the modification device 100 may be configured to include at least the acquiring unit 32A and the adjusting unit 32B that are described later.

The acquiring unit 32A acquires the surface temperature of the processed object 20 from when the plasma processing is performed to when the ink is discharged. According to the present embodiment, the surface temperature that is detected by the detecting unit 36 is acquired as the surface temperature of the processed object 20.

Furthermore, according to the present embodiment, an explanation is given of a case where the detecting unit 36 is located downstream of the plasma processing unit 10 in the conveying direction X and is located upstream of the recording unit 170 in the conveying direction X (see FIG. 10). In this case, the acquiring unit 32A acquires the surface temperature that is detected by the detecting unit 36 as the surface temperature of the processed object 20 from when the plasma processing is performed to when the ink is discharged.

However, there is no limitation on the configuration such that the detecting unit 36 is located downstream of the plasma processing unit 10 in the conveying direction X and is located upstream of the recording unit 170 in the conveying direction X. For example, the detecting unit 36 may be located upstream of the discharge electrode 11 in the conveying direction X. In this case, the acquiring unit 32A previously stores the correlation information that indicates the correlation between the surface temperature of the processed object 20 that is detected at the position where the detecting unit 36 is provided and the surface temperature of the processed object 20 from when the plasma processing is performed to when the ink is discharged as the target that is acquired by the acquiring unit 32A. Then, the acquiring unit 32A may use the surface temperature that is acquired by the detecting unit 36 and the correlation information to calculate the surface temperature of the processed object 20 from when the plasma processing is performed to when the ink is discharged, thereby acquiring the surface temperature.

On the basis of the surface temperature that is acquired by the acquiring unit 32A, the adjusting unit 32B adjusts at least one of the plasma energy amount of the plasma processing unit 10 and the cooling capability of the cooling unit 22 such that the surface of the processed object 20 maintains the target water contact angle at least from when the plasma processing is performed to when the ink is discharged.

Furthermore, it is preferable that, on the basis of at least one of the type of the processed object 20 and the type of ink that is discharged to the processed object 20 and the surface temperature that is acquired by the acquiring unit 32A, the adjusting unit 32B adjusts at least one of the plasma energy amount of the plasma processing unit 10 and the cooling capability of the cooling unit 22 so that the surface of the processed object 20 maintains the target water contact angle at least from when the plasma processing is performed to when the ink is discharged.

In the present embodiment, for example, an explanation is given of a case where, on the basis of the surface temperature that is acquired by the acquiring unit 32A, the adjusting unit 32B adjusts the cooling capability of the cooling unit 22 so that the surface of the processed object 20 maintains the target water contact angle at least from when the plasma processing is performed to when the ink is discharged.

The adjusting unit 32B includes the plasma control unit 32C and the cooling control unit 32D.

The plasma control unit 32C adjusts the plasma processing unit 10 to obtain the plasma energy amount so that the surface of the processed object 20 has a predetermined water contact angle. Specifically, as described above, the plasma control unit 32C adjusts the value of the voltage that is applied to the voltage applying unit 15 of the plasma processing unit 10, the voltage application time, the number of the discharge electrodes 11 to be driven, or the like, so as to obtain the plasma energy amount for getting the predetermined water contact angle.

First, the plasma control unit 32C calculates the plasma energy amount such that the surface of the processed object 20 has the predetermined water contact angle. The predetermined water contact angle may be defined for each of the processed objects 20 that are the targets to be processed, or it may be acquired from the print data that includes the image data on the image to be formed. For example, a configuration is such that the print data includes the image data on the image to be formed and the setting information that includes the predetermined water contact angle and the target water contact angle. Furthermore, the plasma control unit 32C may read the setting information to read the predetermined water contact angle.

For example, a storage unit 38 previously stores first information on the water contact angle and the plasma energy amount that is needed to obtain the water contact angle. The first information may be previously measured by using the printing system 1 and be previously stored in a related manner. Furthermore, the plasma control unit 32C may read, from the first information, the plasma energy amount that corresponds to the predetermined water contact angle that has been read, thereby calculating the plasma energy amount to obtain the predetermined water contact angle.

Furthermore, to obtain the calculated plasma energy amount, the plasma control unit 32C may adjust the value of the voltage that is applied to the discharge electrode 11 from the voltage applying unit 15, the voltage application time, the number of the discharge electrodes 11 to be driven, or the like.

Here, the plasma control unit 32C may calculate the plasma energy amount that is needed to obtain the predetermined water contact angle on the basis of at least one of the type of the processed object 20 and the type of ink that is discharged to the processed object 20.

In this case, for example, the storage unit 38 may previously store second information on the water contact angle, the type of the processed object 20, the type of ink, and the plasma energy amount that is needed to obtain the corresponding water contact angle in a case where the corresponding type of the processed object 20 and the type of ink are used. Moreover, the plasma control unit 32C may read, from the second information, the plasma energy amount that corresponds to the read predetermined water contact angle, the type of the processed object 20 that is the target to be processed, and the type of ink, thereby calculating the plasma energy amount.

Furthermore, in this case, a configuration may be such that the setting information included in the print data includes the predetermined water contact angle, the target water contact angle, the type of the processed object 20 that is the target to be processed, and the type of ink. Furthermore, the plasma control unit 32C may read, from the second information, the plasma energy amount that corresponds to the predetermined water contact angle, the type of the processed object 20, and the type of ink, which are included in the setting information included in the print data.

The cooling control unit 32D adjusts the cooling capability of the cooling unit 22. According to the present embodiment, on the basis of the surface temperature that is acquired by the acquiring unit 32A, the cooling control unit 32D adjusts the cooling capability of the cooling unit 22 to cool the surface of the processed object 20 at least from when the plasma processing is performed to when the ink is discharged so that a temperature at which the target water contact angle range is achieved is obtained during the discharge of the ink to the processed object 20.

The cooling control unit 32D adjusts the cooling capability of at least one of the first cooling unit 22A, the second cooling unit 22B, and the third cooling unit 22C, which are included in the cooling unit 22, thereby adjusting the cooling capability of the cooling unit 22 so that the surface temperature of the processed object 20 during the discharge of the ink to the processed object 20 is a temperature at which the target water contact angle range is achieved.

For example, assume that the cooling unit 22 has a configuration such that, as the drive voltage is higher, or as the voltage application time is longer, the cooling capability (i.e., the capability for obtaining a lower temperature) is higher. In this case, the cooling control unit 32D adjusts at least one of the drive voltage that is applied to the cooling unit 22 and the voltage application time, thereby adjusting the cooling capability.

For example, the storage unit 38 previously stores third information on the target water contact angle, a temperature (the surface temperature of the processed object 20) at which the target water contact angle range is achieved, and the cooling capability of the cooling unit 22 that is needed to obtain the corresponding surface temperature (the temperature in the range). As described above, the cooling capability is represented by using the identification information on the driven cooling unit 22 among the first cooling unit 22A, the second cooling unit 22B, and the third cooling unit 22C and at least one of the drive voltage that is applied to each of the first cooling unit 22A, the second cooling unit 22B, and the third cooling unit 22C and the voltage application time. Furthermore, the cooling capability may be the information that makes it possible to control the cooling capability of the cooling unit 22, and it may include other control information.

Then, the cooling control unit 32D reads the target water contact angle from the setting information that is included in the print data and acquires the surface temperature from the acquiring unit 32A. Then, the cooling control unit 32D reads, from the third information, the cooling capability that corresponds to the read target water contact angle and the acquired surface temperature (the temperature at which the target water contact angle range is achieved). Then, the cooling control unit 32D adjusts the cooling capability of the cooling unit 22 to obtain the read cooling capability.

Furthermore, the cooling control unit 32D may calculate the cooling capability of the cooling unit 22 on the basis of the target water contact angle, the acquired surface temperature, and at least one of the type of the processed object 20 and the type of ink that is discharged to the processed object 20.

In this case, for example, the storage unit 38 may previously store fourth information on the target water contact angle, a temperature (the surface temperature of the processed object 20) at which the target water contact angle range is achieved, the type of the processed object 20, the type of ink, and the cooling capability that is needed to obtain the corresponding target water contact angle in a case where the corresponding type of the processed object 20 with the corresponding surface temperature (the temperature in the range) and the type of ink are used. Furthermore, the cooling control unit 32D may read, from the fourth information, the cooling capability that corresponds to the surface temperature that is acquired by the acquiring unit 32A, the target water contact angle, the type of the processed object 20 that is the target to be processed, and the type of ink, thereby calculating the cooling capability.

Furthermore, in this case, a configuration may be such that the setting information included in the print data includes the predetermined water contact angle, the target water contact angle, the type of the processed object 20 that is the target to be processed, and the type of ink. Moreover, the cooling control unit 32D may read, from the fourth information, the cooling capability that corresponds to the target water contact angle, the type of the processed object 20, and the type of ink, which are included in the setting information included in the print data, and the surface temperature that is acquired by the acquiring unit 32A.

Here, the cooling control unit 32D adjusts the cooling capability of the cooling unit 22 such that, as the surface temperature that is acquired by the acquiring unit 32A is higher, the cooling capability is higher. Therefore, the relationship between the surface temperature and the cooling capability, which is included in the third information and the fourth information, may be previously defined such that, as the surface temperature is higher, the cooling capability is higher (i.e., cooling is conducted to obtain a lower temperature).

The recording control unit 32E controls the recording unit 170 so as to form the image on the image data that is included in the print data.

Next, an explanation is given of the steps of image forming processing that is performed by the image forming apparatus 40. The image forming processing includes plasma processing, cooling processing, and recording processing due to ink discharge.

Figure 12:
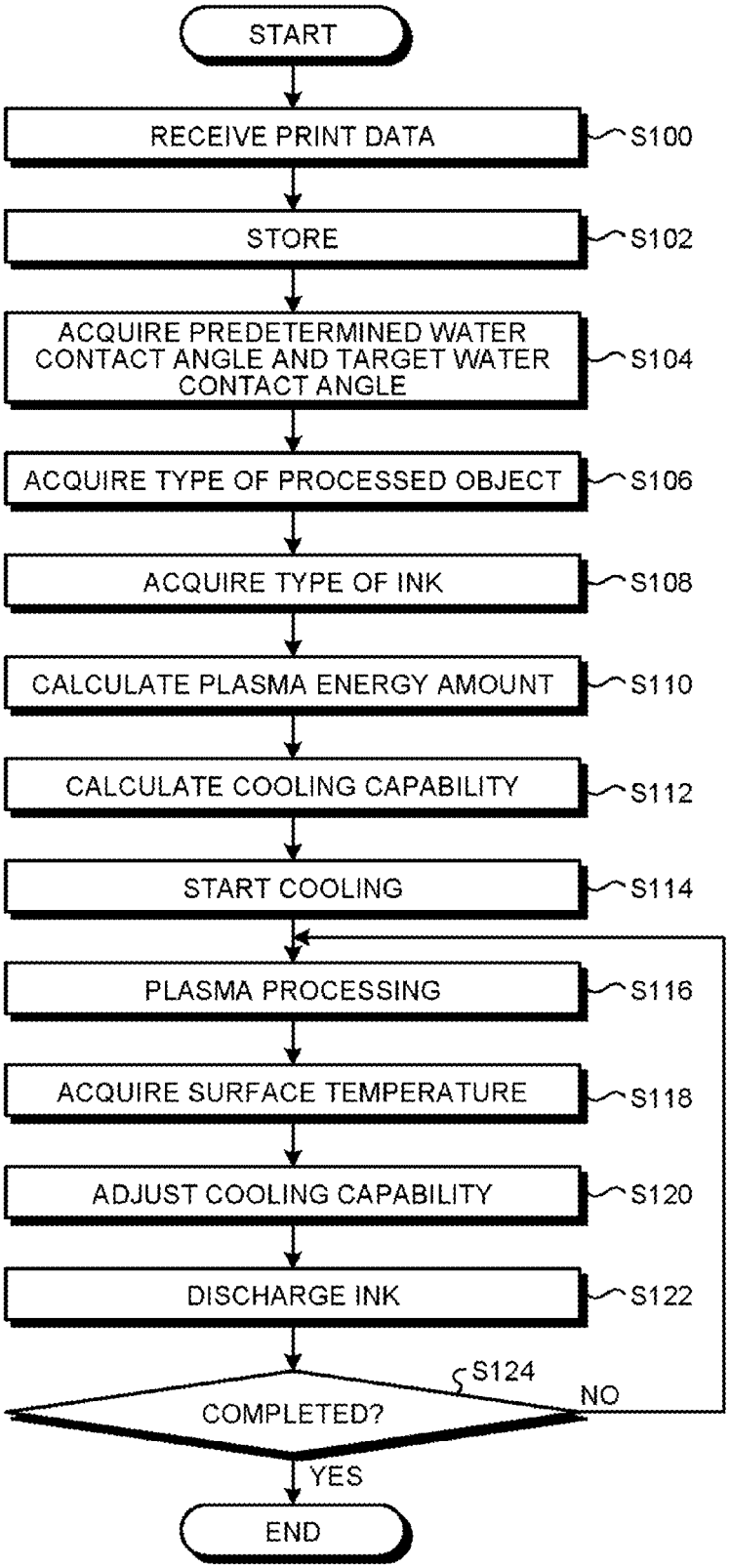
FIG. 12 is a flowchart that illustrates the steps of image forming processing.

FIG. 12 is a flowchart that illustrates the steps of the image forming processing that is performed by the image forming apparatus 40.

First, the control unit 32 receives print data from an external device, or the like (Step S100). Next, the control unit 32 stores the received print data in the storage unit 38 (Step S102).

Next, the adjusting unit 32B acquires the predetermined water contact angle and the target water contact angle (Step S104). The adjusting unit 32B reads, from the setting information included in the print data that is received at Step S100, the predetermined water contact angle and the target water contact angle, thereby acquiring the predetermined water contact angle and the target water contact angle.

Next, the adjusting unit 32B acquires the type of the processed object 20 (Step S106). The adjusting unit 32B reads the type of the processed object 20 from the setting information included in the print data that is received at Step S100, thereby acquiring the type of the processed object 20.

Next, the adjusting unit 32B acquires the type of ink (Step S108). The adjusting unit 32B reads the type of ink from the setting information included in the print data that is received at Step S100, thereby acquiring the type of ink.

Next, the plasma control unit 32C calculates the plasma energy amount to obtain the predetermined water contact angle that is acquired at Step S104 (Step S110). Furthermore, as described above, the plasma control unit 32C may calculate the plasma energy amount on the basis of the predetermined water contact angle that is acquired at Step S104, the type of the processed object 20 that is acquired at Step S106, and the type of ink that is acquired at Step S108.

Next, the cooling control unit 32D calculates the cooling capability as the initial value (Step S112). At Step S112, for example, the cooling control unit 32D calculates the cooling capability that corresponds to the target water angle, which is acquired at Step S104, and the predetermined surface temperature that is a reference temperature. As for the reference temperature, for example, the predicted value of the temperature of the area between the discharge electrode 11 and the earth electrode 14 when the plasma processing unit 10 performs plasma processing is previously set, and the predicted value may be previously set as the reference temperature. Furthermore, the reference temperature may be changed as appropriate due to a user's operation on an undepicted input unit, or the like.

Furthermore, the cooling control unit 32D may calculate the cooling capability that corresponds to the target water contact angle that is acquired at Step S104, the type of the processed object 20 that is acquired at Step S106, the type of ink that is acquired at Step S108, and the surface temperature that is the reference temperature.

Next, the cooling control unit 32D controls the cooling unit 22 so as to obtain the cooling capability that is calculated at Step S112. Thus, the cooling unit 22 starts cooling (Step S114).

Next, the plasma control unit 32C adjusts the plasma processing unit 10 to obtain the plasma energy amount that is calculated at Step S110. Thus, the plasma processing unit 10 performs plasma processing on the processed object 20 by using the plasma energy amount that is calculated at Step S110, i.e., the plasma energy amount for obtaining the target water contact angle that is acquired at Step S104 (Step S116).

Next, the acquiring unit 32A acquires the surface temperature of the processed object 20 from when the plasma processing is performed to when the ink is discharged (Step S118). For example, the acquiring unit 32A acquires the surface temperature that is detected by the detecting unit 36 as the surface temperature of the processed object 20 from when the plasma processing is performed to when the ink is discharged.

Next, the cooling control unit 32D calculates the cooling capability that corresponds to the surface temperature that is acquired at Step S118 and the target water contact angle that is acquired at Step S104. Then, the cooling control unit 32D adjusts the cooling unit 22 so that it conducts cooling by using the calculated cooling capability (Step S120). During the operation at Step S120, the cooling control unit 32D adjusts the cooling capability of the cooling unit 22 on the basis of the surface temperature that is acquired by the acquiring unit 32A.

Furthermore, as described above, the cooling control unit 32D may calculate the cooling capability that corresponds to the surface temperature that is acquired at Step S118, the target water contact angle that is acquired at Step S104, the type of the processed object 20 that is acquired at Step S106, and the type of ink that is acquired at Step S108 and adjust the cooling unit 22.

During the operations at Step S118 to Step S120, the processed object 20, on which the plasma processing has been performed by the plasma processing unit 10, is cooled at least during the period in which it is conveyed to the recording unit 170 along the conveyance path D so that the surface temperature of the processed object 20 during the discharge of the ink to the processed object 20 is a temperature at which the target water contact angle. Thus, a reduction in the modification effect due to plasma processing can be prevented.

Furthermore, the recording control unit 32E controls the recording unit 170 such that the ink droplet that corresponds to the density value of each pixel that is indicated by the image data, which is included in the print data that is received at Step S100, is discharged to the corresponding position (Step S122).

Then, until the image on the image data included in the print data is completely formed (Step S124: Yes), the control unit 32 repeatedly performs the operations at Step S116 to Step S122 (Step S124: No). Then, a positive determination is made at Step S124 (Step S124: Yes), this routine is terminated.

As described above, the modification device 100 according to the present embodiment includes the plasma processing unit 10 and the cooling unit 22. The plasma processing unit 10 performs plasma processing on the processed object 20 so that the surface of the processed object 20 has the predetermined water contact angle. The cooling unit 22 cools the surface of the processed object 20 at least from when the plasma processing is performed to when the ink is discharged so that the surface temperature of the processed object 20 during the discharge of the ink to the processed object 20 is a temperature at which the water contact angle range as the target (the target water contact angle range) is achieved.

As described above, with the configuration such that the cooling unit 22 is provided, the modification device 100 according to the present embodiment can prevent an increase in the water contact angle that has been decreased during plasma processing.

Thus, the modification device 100 according to the present embodiment can prevent a reduction in the modification effect.

Furthermore, according to the present embodiment, as a reduction in the modification effect can be prevented, it is possible to prevent a degradation of the quality of the image that is formed by discharging the ink to the surface of the processed object 20 on which plasma processing has been performed.

Furthermore, as described above, the modification device 100 according to the present embodiment is configured to include the cooling unit 22. Therefore, it is possible to prevent drying of the nozzle that discharges the ink in the recording unit 170.

Furthermore, it is preferable that the cooling unit 22 cools at least one of the first area P1, the second area P2, and the third area P3 on the conveyance path D of the processed object 20, thereby cooling the surface of the processed object 20 at least from when the plasma processing is performed to when the ink is discharged.

The first area P1 is the area that is located upstream of the plasma processing unit 10 on the conveyance path D in the conveying direction X of the processed object 20. The second area P2 is the area where the plasma processing unit 10 performs plasma processing on the processed object 20 on the conveyance path D. The third area P3 is the area that is located downstream of the plasma processing unit 10 on the conveyance path D in the conveying direction X of the processed object 20, and the area continues until before the ink is discharged.

Furthermore, it is preferable that the plasma processing unit 10 is configured to include the discharge electrode 11, the earth electrode 14, and the voltage applying unit 15. The discharge electrode 11 discharges to the processed object 20. The earth electrode 14 is located on the opposite side of the discharge electrode 11. The voltage applying unit 15 applies the voltage to the discharge electrode 11 and the earth electrode 14. The cooling unit 22 includes at least one of the first cooling unit 22A, the second cooling unit 22B, and the third cooling unit 22C. The first cooling unit 22A cools the first area P1 and the third area P3. The second cooling unit 22B cools the inner side of the earth electrode 14, thereby cooling the second area P2. The third cooling unit 22C cools the outer side of the earth electrode 14, thereby cooling the second area P2.

Furthermore, it is preferable that the modification device 100 is configured to further include the acquiring unit 32A and the adjusting unit 32B. The acquiring unit 32A acquires the surface temperature of the processed object 20 from when the plasma processing is performed to when the ink is discharged. The adjusting unit 32B adjusts at least one of the plasma energy amount of the plasma processing unit 10 and the cooling capability of the cooling unit 22 on the basis of the surface temperature that is acquired by the acquiring unit 32A.

Furthermore, it is preferable that the adjusting unit 32B adjusts at least one of the plasma energy amount of the plasma processing unit 10 and the cooling capability of the cooling unit 22 on the basis of at least one of the type of the processed object 20 and the type of ink that is discharged to the processed object 20 and the acquired surface temperature.

Furthermore, it is preferable that the adjusting unit 32B adjusts the cooling capability of the cooling unit 22 such that, as the acquired surface temperature is higher, the cooling capability is higher.

Furthermore, it is preferable that the modification device 100 further includes the detecting unit 36. The detecting unit 36 is located upstream of the recording unit 170, which discharges the ink to the processed object 20, on the conveyance path D of the processed object 20 in the conveying direction X of the processed object 20, and it detects the surface temperature of the processed object 20 that is conveyed on the conveyance path D. The recording unit 170 is located downstream of the plasma processing unit 10 with regard to the conveying direction X of the processed object 20, and it discharges the ink to the processed object 20. The acquiring unit 32A acquires the surface temperature of the processed object 20 from when the plasma processing is performed to when the ink is discharged on the basis of the surface temperature that is detected by the detecting unit 36.

Furthermore, it is preferable that the detecting unit 36 is located upstream of the recording unit 170 on the conveyance path D in the conveying direction X of the processed object 20 and is located downstream of the plasma processing unit 10 in the conveying direction X of the processed object 20.

Furthermore, it is preferable that the detecting unit 36 is located upstream of the recording unit 170 on the conveyance path D in the conveying direction X of the processed object 20, is located downstream of the plasma processing unit 10 in the conveying direction X of the processed object 20, and is located at a position where it can detect the surface temperature of the processed object 20 right after the plasma processing unit 10 performs the plasma processing.

Here, according to the present embodiment, an explanation is given of a case where the modification device 100 is configured to include the detecting unit 36. However, a configuration may be such that the modification device 100 does not include the detecting unit 36. In this case, the cooling capability of the cooling unit 22 may be previously set such that the surface of the processed object 20 is cooled at least from when the plasma processing is performed to when the ink is discharged so that the surface temperature of the processed object 20 during the discharge of the ink to the processed object 20 is kept at a temperature at which the predetermined target water contact angle range is achieved. Moreover, the cooling unit 22 may cool the processed object 20 by using the previously set cooling capability.

In this case, for example, the cooling capability of the cooling unit 22 is previously set with regard to each plasma energy of the plasma processing unit 10. The above cooling capability may be the cooling capability with which, when plasma processing is performed by using the corresponding plasma energy, the surface of the processed object 20 can be cooled at least from when the plasma processing is performed to when the ink is discharged so that the surface of the processed object 20 maintains the target water contact angle at least from when the plasma processing is performed to when the ink is discharged. Furthermore, the adjusting unit 32B may adjust the cooling capability of the cooling unit 22 so as to obtain the cooling capability that corresponds to the plasma energy of the plasma processing unit 10.

Furthermore, in the present embodiment, an explanation is given of the configuration such that the printing system 1 (and the image forming apparatus 40) includes the single modification device 100; however, a configuration may be such that it includes the multiple modification devices 100. Moreover, the printing system 1 may be configured to handle two-sided printing.

Second Embodiment

In the above-described embodiment, an explanation is given of a case where, for example, the printing system 1 (and the image forming apparatus 40) adjusts the cooling capability of the cooling unit 22 on the basis of the surface temperature that is acquired by the acquiring unit 32A.

However, the printing system (and the image forming apparatus) may adjust at least one of the plasma energy amount of the plasma processing unit 10 and the cooling capability of the cooling unit 22 on the basis of the surface temperature that is acquired by the acquiring unit 32A.

In the present embodiment, an explanation is given of a case where the printing system (and the image forming apparatus) adjusts both the plasma energy amount of the plasma processing unit 10 and the cooling capability of the cooling unit 22 on the basis of the surface temperature that is acquired by the acquiring unit 32A.

FIG. 9 and FIG. 10 are schematic diagrams of a printing system 1B according to the present embodiment. Here, the printing system 1B has the same configuration as the printing system 1 except that it includes an image forming apparatus 40B instead of the image forming apparatus 40.

The image forming apparatus 40B includes a modification device 100B and the recording unit 170. The modification device 100B includes the plasma processing unit 10, the cooling unit 22, and a control unit 33. The image forming apparatus 40B has the same configuration as the image forming apparatus 40 except that it includes the modification device 100B instead of the modification device 100. Furthermore, the modification device 100B has the same configuration as the modification device 100 except that it includes the control unit 33 instead of the control unit 32.

Furthermore, in the explanations according to the present embodiment, the control unit 33 controls the image forming apparatus 40B. However, the control unit 33 may be configured to include, as separate units, a control unit that controls the modification device 100B, a control unit that controls the recording unit 170, and a control unit that controls each of the other components that are provided in the image forming apparatus 40B.

Figure 13:
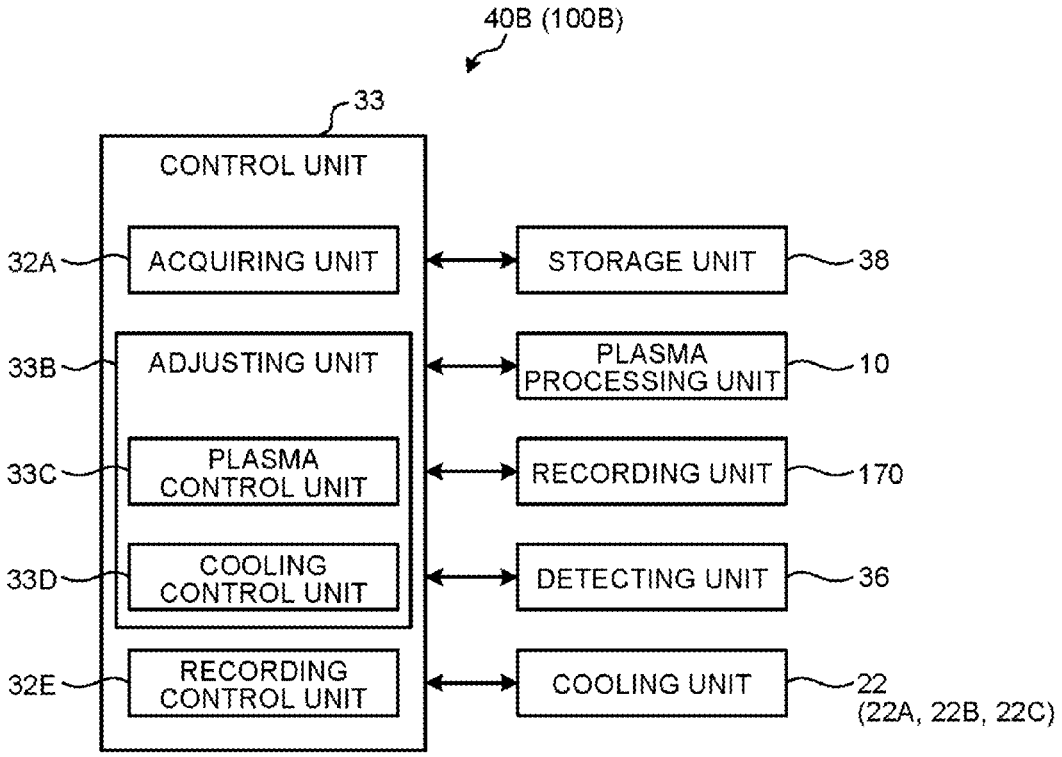
FIG. 13 is a functional block diagram of the control unit.

FIG. 13 is a functional block diagram of the control unit 33. The control unit 33 includes the acquiring unit 32A, an adjusting unit 33B, and the recording control unit 32E. The acquiring unit 32A and the recording control unit 32E are the same as those in the first embodiment. The adjusting unit 33B includes a plasma control unit 33C and a cooling control unit 33D.

All or some of the acquiring unit 32A, the plasma control unit 33C, the cooling control unit 33D, and the recording control unit 32E may be implemented by, for example, causing a processing device, such as a CPU, to execute a program, i.e., by using software, may be implemented by using hardware, such as an IC, or may be implemented by using software and hardware in combination.

The adjusting unit 33B adjusts both the plasma energy amount of the plasma processing unit 10 and the cooling capability of the cooling unit 22 so that the surface of the processed object 20 maintains the target water contact angle at least from when the plasma processing is performed to when the ink is discharged on the basis of the surface temperature that is acquired by the acquiring unit 32A.

Furthermore, it is preferable that the adjusting unit 33B adjusts both the plasma energy amount of the plasma processing unit 10 and the cooling capability of the cooling unit 22 on the basis of at least one of the type of the processed object 20 and the type of ink that is discharged to the processed object 20 and the surface temperature that is acquired by the acquiring unit 32A.

The adjusting unit 33B includes the plasma control unit 33C and the cooling control unit 33D.

The plasma control unit 33C adjusts the plasma processing unit 10 so as to obtain the plasma energy amount with which the surface of the processed object 20 has a predetermined water contact angle. Specifically, the plasma control unit 33C adjusts the value of the voltage that is applied to the voltage applying unit 15 of the plasma processing unit 10, the voltage application time, the number of the discharge electrodes 11 to be driven, or the like, so as to obtain the plasma energy amount for getting a predetermined water contact angle. The adjustment method that is implemented by the plasma control unit 33C to obtain the plasma energy amount for getting a predetermined water contact angle of the surface of the processed object 20 is the same as that by the plasma control unit 32C according to the first embodiment. That is, the method that is implemented by the plasma control unit 33C to calculate the plasma energy for obtaining a predetermined water contact angle of the surface of the processed object 20 is the same as that by the plasma control unit 32C.

According to the present embodiment, on the basis of the surface temperature that is acquired by the acquiring unit 32A, the plasma control unit 33C further adjusts the plasma energy amount of the plasma processing unit 10 so that the surface of the processed object 20 during the discharge of the ink to the processed object 20 indicates the target water contact angle.

Specifically, the plasma control unit 33C adjusts the plasma energy amount of the plasma processing unit 10 such that, as the surface temperature that is acquired by the acquiring unit 32A is higher, the plasma energy amount is larger. By this adjustment, the plasma control unit 33C adjusts the plasma energy amount of the plasma processing unit 10 so that the surface of the processed object 20 during the discharge of the ink to the processed object 20 indicates the target water contact angle.

Furthermore, during the above adjustment of the plasma energy amount, the plasma control unit 33C adjusts the plasma energy amount of the plasma processing unit 10 such that it is equal to or greater than the plasma energy amount for obtaining the target water contact angle and such that, as the surface temperature that is acquired by the acquiring unit 32A is higher, the plasma energy amount is larger.

First, the plasma control unit 33C calculates an adjustment value of the plasma energy amount that corresponds to the surface temperature that is acquired by the acquiring unit 32A.

For example, the storage unit 38 previously stores fifth information on the target water contact angle, a temperature (the surface temperature of the processed object 20) at which the target water contact angle range is achieved, the cooling capability of the cooling unit 22 that is needed to obtain the corresponding surface temperature, and the adjustment value of the plasma energy amount that is needed to offset an increase in the water contact angle with respect to the corresponding target water contact angle. The cooling capability is defined in the same manner as in the first embodiment.

The adjustment value of the plasma energy amount is the difference between the plasma energy amount that needs to be previously applied by the plasma processing unit 10 so that the water contact angle of the processed object 20 at least right before the ink is discharged indicates the target water contact angle and the plasma energy amount with which the water contact angle of the processed object 20 during plasma processing (right after the processing) becomes the target water contact angle.

The adjustment value of the plasma energy amount in the fifth information may be previously measured and set in accordance with the correlation among the corresponding cooling capability, the conveying time of the processed object 20 from when the plasma processing is performed to when the ink is discharged, and the target water contact angle. Specifically, the fifth information may be previously measured by using the printing system 1B and be previously stored in a related manner. Furthermore, in the fifth information, a unique value is set to the cooling capability in accordance with the corresponding target water contact angle and the surface temperature of the processed object 20; however, this is not a limitation. Moreover, in the fifth information, a unique value is set to the adjustment value of the plasma energy amount in accordance with the corresponding target water contact angle and the surface temperature of the processed object 20; however, this is not a limitation.

Then, the plasma control unit 33C reads, from the fifth information, the adjustment value of the plasma energy amount that corresponds to the target water contact angle and the surface temperature that is acquired by the acquiring unit 32A. Then, the plasma control unit 33C calculates the plasma energy amount by adding the read adjustment value of the plasma energy to the plasma energy amount that corresponds to the previously set target water contact angle.

Then, the plasma control unit 33C may adjust the value of the voltage that is applied to the discharge electrode 11 from the voltage applying unit 15, the voltage application time, the number of the discharge electrodes 11 to be driven, or the like, so as to obtain the calculated plasma energy amount. During this processing, on the basis of the surface temperature that is acquired by the acquiring unit 32A, the plasma control unit 33C adjusts the plasma energy amount of the plasma processing unit 10 so that the surface of the processed object 20 during the discharge of the ink to the processed object 20 indicates the target water contact angle. Specifically, the plasma control unit 33C adjusts the plasma energy amount of the plasma processing unit 10 such that it is equal to or greater than the plasma energy amount for obtaining the corresponding target water contact angle and such that, as the surface temperature that is acquired by the acquiring unit 32A is higher, the plasma energy amount is larger.

Furthermore, the plasma control unit 33C may calculate the adjustment value of the plasma energy amount on the basis of at least one of the type of the processed object 20 and the type of ink that is discharged to the processed object 20 as is the case with the calculation of the plasma energy amount that is needed to obtain the target water contact angle.

In this case, for example, the storage unit 38 may previously store the above-described fifth information that corresponds to the target water contact angle, the type of the processed object 20, and the type of ink. Furthermore, the plasma control unit 33C may read the adjustment value of the plasma energy amount that corresponds to the target water contact angle and the surface temperature that is acquired by the acquiring unit 32A in the fifth information that corresponds to the type of the processed object 20 and the type of ink.

The cooling control unit 33D adjusts the cooling capability of the cooling unit 22. The cooling control unit 33D adjusts the cooling capability of the cooling unit 22 on the basis of the surface temperature that is acquired by the acquiring unit 32A so that the surface temperature of the processed object 20 during the discharge of the ink to the processed object 20 is a temperature at which the target water contact angle range is achieved.

As is the case with the cooling control unit 32D according to the first embodiment, the cooling control unit 33D adjusts the cooling capability of at least one of the first cooling unit 22A, the second cooling unit 22B, and the third cooling unit 22C, which are included in the cooling unit 22, thereby adjusting the cooling capability so that the surface temperature of the processed object 20 during the discharge of the ink to the processed object 20 is a temperature at which the target water contact angle range is achieved.

For example, the cooling unit 22 has a configuration such that, as the drive voltage is higher and, as the voltage application time is longer, the cooling capability (i.e., the capability for obtaining a lower temperature) is higher. In this case, the cooling control unit 33D adjusts the cooling capability by adjusting at least one of the drive voltage that is applied to the cooling unit 22 and the voltage application time.

According to the present embodiment, the cooling control unit 33D reads the target water contact angle from the setting information included in the print data and acquires the surface temperature from the acquiring unit 32A. Furthermore, the cooling control unit 33D reads, from the above-described fifth information, the cooling capability that corresponds to the read target water contact angle and the acquired surface temperature. Then, the cooling control unit 33D adjusts the cooling capability of the cooling unit 22 so as to obtain the read cooling capability.

Furthermore, the cooling control unit 33D may calculate the cooling capability of the cooling unit 22 in accordance with the target water contact angle, the surface temperature, and at least one of the type of the processed object 20 and the type of ink that is discharged to the processed object 20.

In this case, as is the case with the foregoing, for example, the storage unit 38 may previously store the above-described fifth information that corresponds to the target water contact angle, the type of the processed object 20, and the type of ink. Then, the plasma control unit 33C may read the cooling capability that corresponds to the target water contact angle and the surface temperature that is acquired by the acquiring unit 32A, in the fifth information that corresponds to the type of the processed object 20 and the type of ink.

Furthermore, the cooling control unit 33D adjusts the cooling capability of the cooling unit 22 such that, as the surface temperature that is acquired by the acquiring unit 32A is higher, the cooling capability is higher. Therefore, the relationship between the surface temperature and the cooling capability, which is included in the fifth information, may be previously defined such that, as the surface temperature is higher, the cooling capability is higher (i.e., cooling is conducted to obtain a lower temperature).

Next, an explanation is given of the steps of the image forming processing that is performed by the image forming apparatus 40B according to the present embodiment. The image forming processing includes plasma processing, cooling processing, and recording processing due to ink discharge.

Figure 14:
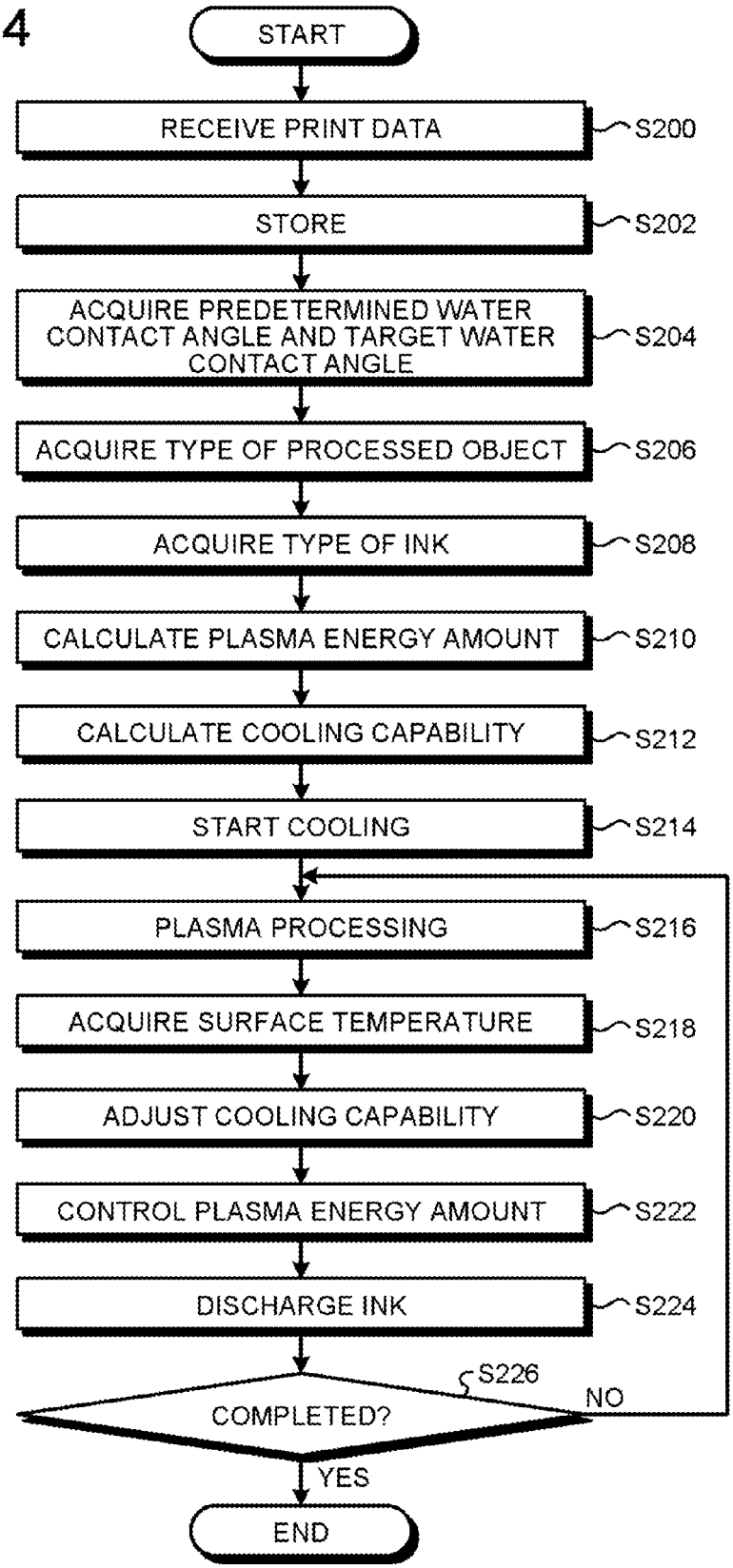
FIG. 14 is a flowchart that illustrates the steps of image forming processing.

FIG. 14 is a flowchart that illustrates the steps of the image forming processing that is performed by the image forming apparatus 40B.

First, the control unit 33 receives print data from an external device, or the like (Step S200). Next, the control unit 33 stores the received print data in the storage unit 38 (Step S202).

Next, the adjusting unit 33B acquires the predetermined water contact angle and the target water contact angle (Step S204). The adjusting unit 33B reads, from the setting information included in the print data that is received at Step S200, the predetermined water contact angle and the target water contact angle, thereby acquiring the predetermined water contact angle and the target water contact angle.

Next, the adjusting unit 33B acquires the type of the processed object 20 (Step S206). The adjusting unit 33B reads the type of the processed object 20 from the setting information included in the print data that is received at Step S200, thereby acquiring the type of the processed object 20.

Next, the adjusting unit 33B acquires the type of ink (Step S208). The adjusting unit 33B reads the type of ink from the setting information included in the print data that is received at Step S200, thereby acquiring the type of ink.

Next, the plasma control unit 33C calculates the plasma energy amount to obtain the predetermined water contact angle that is acquired at Step S204 (Step S210). Here, as described above, the plasma control unit 33C may calculate the plasma energy amount on the basis of the predetermined water contact angle that is acquired at Step S204, the type of the processed object 20 that is acquired at Step S206, and the type of ink that is acquired at Step S208.

Next, the cooling control unit 33D calculates the cooling capability as the initial value (Step S212). At Step S212, for example, the cooling control unit 33D calculates the cooling capability that corresponds to the target water contact angle that is acquired at Step S204 and the predetermined surface temperature that is the reference temperature. As for the reference temperature, for example, the predicted value of the temperature of the area between the discharge electrode 11 and the earth electrode 14 when the plasma processing unit 10 performs plasma processing is previously set, and the predicted value may be previously set as the reference temperature. Here, the reference temperature may be changed as appropriate due to a user's operation on an undepicted input unit, or the like.

Next, the cooling control unit 33D controls the cooling unit 22 so as to obtain the cooling capability that is calculated at Step S212. Thus, the cooling unit 22 starts cooling (Step S214).

Next, the plasma control unit 33C adjusts the plasma processing unit 10 so as to obtain the plasma energy amount that is calculated at Step S210. Thus, the plasma processing unit 10 performs plasma processing on the processed object 20 by using the plasma energy amount that is calculated Step S210, i.e., the plasma energy amount for obtaining the target water contact angle that is acquired at Step S204 (Step S216).

Next, the acquiring unit 32A acquires the surface temperature of the processed object 20 from when the plasma processing is performed to when the ink is discharged (Step S218). For example, the acquiring unit 32A acquires the surface temperature that is detected by the detecting unit 36 as the surface temperature of the processed object 20 from when the plasma processing is performed to when the ink is discharged.

Next, the cooling control unit 33D uses the fifth information to calculate the cooling capability that corresponds to the surface temperature that is acquired at Step S218 and the target water contact angle that is acquired at Step S204. Then, the cooling control unit 33D adjusts the cooling unit 22 so as to perform cooling by using the calculated cooling capability (Step S220).

Next, the plasma control unit 33C uses the fifth information to calculate the adjustment value of the plasma energy amount that corresponds to the surface temperature that is acquired at Step S218 and the target water contact angle that is acquired at Step S204. Then, the plasma control unit 33C controls the plasma processing unit 10 so as to obtain the plasma energy amount by adding the calculated adjustment value of the plasma energy amount to the plasma energy amount that is calculated at Step S210 (Step S222).

Then, the recording control unit 32E controls the recording unit 170 such that the ink droplet that corresponds to the density value of each pixel that is indicated by the image data, which is included in the print data that is received at Step S200, is discharged to the corresponding position (Step S224).

During the operations at Step S218 to Step S222, the processed object 20, on which plasma processing has been performed by the plasma processing unit 10, is cooled at least during the period in which it is conveyed to the recording unit 170 along the conveyance path D so that the surface temperature of the processed object 20 during the discharge of the ink to the processed object 20 is a temperature at which the target water contact angle range is achieved. Thus, a reduction in the modification effect due to the plasma processing can be prevented. Furthermore, during the operations at Step S218 to Step S222, the plasma energy amount of the plasma processing unit 10 is adjusted in accordance with the surface temperature so that the surface of the processed object 20 during the discharge of the ink to the processed object 20 indicates the target water contact angle.

Then, the control unit 33 repeatedly performs the operations at Step S216 to Step S226 (Step S226: No) until the image on the image data included in the print data is completely formed (Step S226: Yes). Then, if a positive determination is made at Step S226 (Step S226: Yes), this routine is terminated.

As described above, in the modification device 100B according to the present embodiment, the acquiring unit 32A acquires the surface temperature of the processed object 20 from when the plasma processing is performed to when the ink is discharged. The adjusting unit 33B adjusts both the plasma energy amount of the plasma processing unit 10 and the cooling capability of the cooling unit 22 on the basis of the surface temperature that is acquired by the acquiring unit 32A.

Thus, with the modification device 100B according to the present embodiment, it is possible to prevent an increase in the water contact angle that has been decreased during the plasma processing.

Thus, with the modification device 100B according to the present embodiment, a reduction in the modification effect can be prevented.

Furthermore, in the present embodiment, an explanation is given of a case where the adjusting unit 33B adjusts both the plasma energy amount of the plasma processing unit 10 and the cooling capability of the cooling unit 22 on the basis of the surface temperature that is acquired by the acquiring unit 32A.

However, the adjusting unit 33B may adjust only the plasma energy amount of the plasma processing unit 10 while the cooling capability of the cooling unit 22 is fixed.

In this case, the cooling capability of the cooling unit 22 may be fixed to the cooling capability such that, for example, the surface temperature of the processed object 20 at least from when the plasma processing is performed to when the ink is discharged is decreased so that the surface temperature of the processed object 20 during the discharge of the ink to the processed object 20 is a temperature at which the target water contact angle range is achieved. Furthermore, on the basis of the surface temperature that is acquired by the acquiring unit 32A, the adjusting unit 33B may adjust the plasma energy amount of the plasma processing unit 10 so that the surface of the processed object 20 during the discharge of the ink to the processed object 20 indicates the target water contact angle.

In this case, too, the plasma control unit 33C may adjust the plasma energy amount of the plasma processing unit 10 such that, as the acquired surface temperature is higher, the plasma energy amount is larger.

Third Embodiment

Here, in the above-described embodiment, an explanation is given of a case where the plasma processing unit 10 performs plasma processing on the processed object 20 so that the surface of the processed object 20 has a predetermined water contact angle, and the cooling unit 22 cools the surface of the processed object 20 at least from when the plasma processing is performed to when the ink is discharged so that the surface temperature of the processed object 20 during the discharge of the ink to the processed object 20 is a temperature at which the target water contact angle range is achieved.

Here, as described above, according to the results of FIG. 7, or the like, the inventors have found out that separation of hydroxyl (OH) due to heat causes an increase in the pH, which has been decreased during plasma processing, and the modification effect is reduced.

Thus, according to the present embodiment, the plasma processing unit 10 performs plasma processing on the processed object 20 so that the surface of the processed object 20 has a predetermined pH value. The plasma processing unit 10 and the plasma control units 32C and 33C (see FIG. 11 and FIG. 13) may perform the same operation as that in the above-described embodiment except that they use a predetermined pH value instead of the above-described predetermined water contact angle. The predetermined pH value is obtained during plasma processing, and it is the pH value of the surface of the processed object 20 right after plasma processing. The predetermined pH value is previously set by a user, for example.

Furthermore, according to the present embodiment, the cooling unit 22 cools the surface of the processed object 20 at least from when the plasma processing is performed to when the ink is discharged so that the surface of the processed object 20 during the discharge of the ink to the processed object 20 has a temperature at which the target pH value range is achieved.

The target pH value range is the target pH value range of the processed object 20 right before the ink is discharged. The target pH value range is previously set by a user. The target pH value range corresponds to a value equal to or less than the above-described predetermined pH value. Furthermore, a temperature at which the target pH value range is achieved indicates a temperature range in which the surface of the processed object 20 can maintain the target pH value range.

According to the present embodiment, the cooling unit 22 and the cooling control units 32D and 33D (see FIG. 11 and FIG. 13) may perform the same operation as that in the above-described embodiment except that they use the target pH value instead of the above-described target water contact angle and use a temperature at which the target pH value range is achieved instead of a temperature at which the target water contact angle range is achieved.

As described above, the plasma processing unit 10 performs plasma processing on the processed object 20 so that the surface of the processed object 20 has a predetermined pH value, and the cooling unit 22 cools the surface of the processed object 20 at least from when the plasma processing is performed to when the ink is discharged so that the surface of the processed object 20 during the discharge of the ink to the processed object 20 has a temperature at which the target pH value range is achieved.

Therefore, with the modification device 100B according to the present embodiment that is configured to include the above-described cooling unit 22, an increase in the pH value that has been decreased during plasma processing can be prevented, and a reduction in the modification effect can be prevented. Furthermore, according to the present embodiment, as a reduction in the modification effect can be prevented, it is possible to prevent a degradation of the quality of the image that is formed by discharging the ink to the surface of the processed object 20 on which plasma processing has been performed.

Fourth Embodiment

Next, an explanation is given of the hardware configuration of the above-described modification device 100, the modification device 100B, the image forming apparatus 40, and the image forming apparatus 40B.

Figure 15:
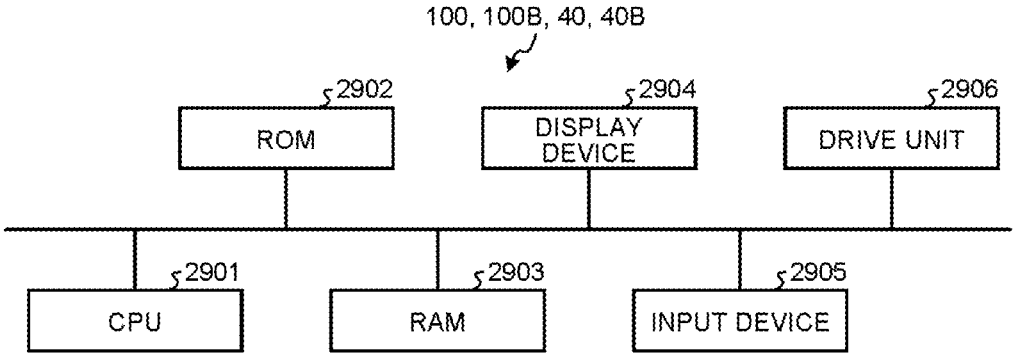
FIG. 15 is a hardware configuration diagram.

FIG. 15 is a hardware configuration diagram of the modification device 100, the modification device 100B, the image forming apparatus 40, and the image forming apparatus 40B. The modification device 100, the modification device 100B, the image forming apparatus 40, and the image forming apparatus 40B principally include, as the hardware configuration, a CPU 2901 that performs the overall control on the device; a ROM 2902 that stores various types of data and various programs; a RAM 2903 that stores various types of data and various programs; an input device 2905, such as a keyboard or a mouse; and a display device 2904, such as a display device, and they have the hardware configuration that uses a typical computer.

A drive unit 2906 corresponds to each unit (e.g., the plasma processing unit 10, the cooling unit 22, the detecting unit 36, or the like) of the device that is controlled by the CPU 2901 of each of the modification device 100, the modification device 100B, the image forming apparatus 40, and the image forming apparatus 40B.

A program to be executed by the modification device 100, the modification device 100B, the image forming apparatus 40, and the image forming apparatus 40B according to the above-described embodiment is provided as a computer program product by being recorded, in the form of a file that is installable or executable, in a storage medium readable by a computer, such as a CD-ROM, a flexible disk (FD), a CD-R, or a digital versatile disk (DVD).

Furthermore, a configuration may be such that the program to be executed by the modification device 100, the modification device 100B, the image forming apparatus 40, and the image forming apparatus 40B according to the above-described embodiment is stored in a computer connected via a network, such as the Internet, and is provided by being downloaded via the network. Moreover, a configuration may be such that the program to be executed by the modification device 100, the modification device 100B, the image forming apparatus 40, and the image forming apparatus 40B according to the above-described embodiment is provided or distributed via a network, such as the Internet.

Furthermore, a configuration may be such that the program to be executed by the modification device 100, the modification device 100B, the image forming apparatus 40, and the image forming apparatus 40B according to the above-described embodiment is provided such that it is previously installed in the ROM 2902, or the like.

The program to be executed by the modification device 100, the modification device 100B, the image forming apparatus 40, and the image forming apparatus 40B according to the above-described embodiment has a modular configuration that includes the above-described units, and in terms of the actual hardware, the CPU (processor) 2901 reads the program from the above-described storage medium and executes it so as to load the above-described units into a main storage device so that each of the above-described units is generated in the main storage device.

According to an embodiment, it is possible to provide an advantage that a reduction in the modification effect of the surface of a processed object can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A modification device comprising:

a plasma processing unit that performs plasma processing on a processed object such that a surface of the processed object has a predetermined water contact angle; and a cooling unit that cools the surface of the processed object at least from when the plasma processing is performed to when ink is discharged such that a surface temperature of the processed object during discharge of the ink to the processed object is a temperature at which a target water contact angle range is achieved.

2. The modification device according to claim 1, wherein the cooling unit cools at least one of a first area that is located upstream of the plasma processing unit on a conveyance path of the processed object in a conveying direction of the processed object, a second area where the plasma processing unit performs plasma processing on the processed object, and a third area that is located downstream of the plasma processing unit in the conveying direction of the processed object and that continues until before ink is discharged.

3. The modification device according to claim 2, wherein the plasma processing unit includes a discharge electrode that discharges to the processed object;

an earth electrode that is located opposite to the discharge electrode; and a voltage applying unit that applies a voltage to the discharge electrode and the earth electrode, and the cooling unit includes at least one of a first cooling unit that cools the first area and the third area, a second cooling unit that cools an inner side of the earth electrode to cool the second area, and a third cooling unit that cools an outer side of the earth electrode to cool the second area.

4. The modification device according to claim 1, further comprising:

an acquiring unit that acquires a surface temperature of the processed object from when the plasma processing is performed to when ink is discharged; and an adjusting unit that adjusts at least one of a plasma energy amount of the plasma processing unit and a cooling capability of the cooling unit in accordance with the acquired surface temperature.

5. The modification device according to claim 4, wherein the adjusting unit adjusts at least one of the plasma energy amount of the plasma processing unit and the cooling capability of the cooling unit in accordance with at least one of a type of the processed object and a type of ink that is discharged to the processed object and the acquired surface temperature.

6. The modification device according to claim 4, wherein the adjusting unit adjusts the plasma energy amount of the plasma processing unit such that, as the acquired surface temperature is higher, the plasma energy amount is larger.

7. The modification device according to claim 4, wherein the adjusting unit adjusts the cooling capability of the cooling unit such that, as the acquired surface temperature is higher, the cooling capability is higher.

8. The modification device according to claim 4, further comprising a detecting unit that is located upstream of a recording unit in a conveying direction of the processed object and that detects a surface temperature of the processed object that is conveyed on the conveyance path, the recording unit being located downstream of the plasma processing unit on a conveyance path of the processed object in the conveying direction of the processed object to discharge ink to the processed object, wherein the acquiring unit acquires a surface temperature of the processed object from when the plasma processing is performed to when ink is discharged in accordance with the surface temperature that is detected by the detecting unit.

9. The modification device according to claim 8, wherein the detecting unit is located upstream of the recording unit on the conveyance path in the conveying direction of the processed object and is located downstream of the plasma processing unit in the conveying direction of the processed object.

10. The modification device according to claim 9, wherein the detecting unit is located upstream of the recording unit on the conveyance path in the conveying direction of the processed object, is located downstream of the plasma processing unit in the conveying direction of the processed object, and is located at a position where the detecting unit is capable of detecting a surface temperature of the processed object right after the plasma processing unit performs the plasma processing.

11. An image forming apparatus comprising:

the modification device according to claim 1; and a recording unit that is located downstream of the plasma processing unit in a conveying direction of the processed object and that discharges ink to the processed object.

12. An image forming system comprising:

the modification device according to claim 1; and a recording unit that is located downstream of the plasma processing unit in a conveying direction of the processed object and that discharges ink to the processed object.

13. A modification method comprising:

performing plasma processing on a processed object such that a surface of the processed object has a predetermined water contact angle; and cooling the surface of the processed object at least from when the plasma processing is performed to when ink is discharged such that a surface temperature of the processed object during discharge of the ink to the processed object is a temperature at which a target water contact angle range is achieved.

14. A computer program product comprising a non-transitory computer-readable medium having an information processing program, the program causing a computer to execute:

performing plasma processing on a processed object such that a surface of the processed object has a predetermined water contact angle; and cooling the surface of the processed object at least from when the plasma processing is performed to when ink is discharged such that a surface temperature of the processed object during discharge of the ink to the processed object is a temperature at which a target water contact angle range is achieved.

* * * * *